US006361906B1

(12) United States Patent
Kawase et al.

(10) Patent No.: US 6,361,906 B1
(45) **Date of Patent: *Mar. 26, 2002**

(54) METHOD OF FORMING TONER IMAGE ON IMAGE TRANSFER SHEET, METHOD OF FIRE FIXING IMAGE ON HEAT-RESISTANT SOLID SURFACE, DEVELOPER AND TONER IMAGE BEARING TRANSFER SHEET

(75) Inventors: Hiromitsu Kawase; Masaru Matsuda, both of Shizuoka (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/577,987

(22) Filed: May 25, 2000

Related U.S. Application Data

(62) Division of application No. 09/154,721, filed on Sep. 17, 1998, now Pat. No. 6,153,343.

(30) Foreign Application Priority Data

| | | |
|---|---|---|
| Sep. 17, 1997 | (JP) | 09-270467 |
| Sep. 17, 1997 | (JP) | 09-270468 |
| Sep. 24, 1997 | (JP) | 09-276585 |
| Oct. 6, 1997 | (JP) | 09-289106 |
| Oct. 6, 1997 | (JP) | 09-289107 |
| Oct. 15, 1997 | (JP) | 09-297703 |

(51) Int. Cl.[7] ..... G03C 3/00; G03C 13/20

(52) U.S. Cl. ..... 430/18; 430/124

(58) Field of Search ..... 430/124, 18

(56) References Cited

U.S. PATENT DOCUMENTS

| | | | | |
|---|---|---|---|---|
| 4,963,454 A | | 10/1990 | Yano et al. | 430/106.6 |
| 4,990,427 A | | 2/1991 | Kohri et al. | 430/110 |
| 5,913,092 A | * | 6/1999 | Bisaiji et al. | 399/49 |

FOREIGN PATENT DOCUMENTS

| | | |
|---|---|---|
| EP | 0 238 130 | 9/1987 |
| EP | 0 738 937 | 10/1996 |
| EP | 0 751 434 | 1/1997 |
| GB | 2 072 362 | 9/1981 |
| GB | 2 200 470 | 8/1988 |
| WO | 96-33446 | * 10/1996 |

* cited by examiner

*Primary Examiner*—Mark Chapman
(74) *Attorney, Agent, or Firm*—Oblon, Spivak, McClelland, Maier & Neustadt, P.C.

(57) ABSTRACT

A method of forming a toner image on an image transfer sheet include the steps of forming a latent electrostatic image on an image bearing member, developing the latent electrostatic image to a toner image, using a developer, and transferring the toner image to an image transfer sheet, with the developer having a carrier and a toner which contains a thermoplastic resin and a coloring agent having a chromatic color and capable of retaining the chromatic color even after the toner is sintered, and satisfying at least one of three conditions that (1) a toner concentration in the developer is in a range of 8 to 24 wt. %, (2) the toner has an absolute charge quantity value of 12 $\mu$C/g or less, and (3) a ratio of a true specific gravity of the carrier to that of the toner is in a range of 2 to 3. An image can be fixed on a heat-resistant solid surface by further attaching the toner image transferred to the image transfer sheet to a heat-resistant solid surface and sintering the toner image. Further, a developer and a toner image bearing transfer sheet are also disclosed.

10 Claims, 4 Drawing Sheets

METHOD OF FORMING TONER IMAGE ON IMAGE TRANSFER SHEET, METHOD OF FIRE FIXING IMAGE ON HEAT-RESISTANT SOLID SURFACE, DEVELOPER AND TONER IMAGE BEARING TRANSFER SHEET

This application is a Division of application Ser. No. 09/154,721 Filed on Sep. 17, 1998, now U.S. Pat. No. 6,153,343.

BACKGROUND OF THE INVENTION

1. Field of the Invention

The present invention relates to a method of forming a toner image on an image transfer sheet, comprising the steps of developing a latent electrostatic image formed on an image bearing member to a toner image using a developer comprising a toner which comprises a coloring agent having a chromatic color and being capable of retaining the chromatic color when the toner is sintered, and transferring the toner image from the image bearing member to an image transfer sheet, thereby obtaining a toner image bearing transfer sheet. The present invention also relates to a method of fire fixing an image on a heat resistant solid surface using the above obtained toner image bearing transfer sheet. In addition, the present invention also relates to the above-mentioned developer and toner image bearing transfer sheet for use with the fire fixing method.

2. Discussion of Background

To form an image or pattern on the surface of a heat-resistant solid such as ceramics, a desired image or pattern is directly written on the surface of the heat-resistant solid with a brush using a coloring material comprising an inorganic pigment and a glaze, and thereafter the image bearing heat-resistant solid is subjected to firing at 750 to 1,300° C.

According to the above-mentioned conventional firing method, some components for use in the coloring material are sintered and the glaze is melted in the course of the firing step, and the inorganic pigment is fixed to the heat-resistant solid surface by the aid of the glaze when cooled to room temperature after sintered. Thus, there remains on the heat-resistant solid surface the image first, formed thereon in handwriting.

The above-mentioned firing method has the drawback that the same image or pattern must be formed in handwriting on a plurality of ceramic products only by a skilled craftsman no matter how simple the image or pattern may be.

To produce large quantities of ceramic products which bear the same image or pattern thereon, it is therefore proposed that a desired image be first formed on a transfer sheet by screen printing process. The thus formed image-bearing portion is separated from the transfer sheet and attached to the surface of each ceramic product, and then sintered so as to fix the image to the ceramic product.

The above-mentioned fire fixing method using the screen printing process is proposed, for instance, as disclosed in Japanese Laid-Open Patent Application 49-35407. By this kind of fire fixing method, a colored image is formed on a ceramic product in accordance with the following procedure:

A transfer sheet comprises a support and a water-soluble paste layer formed thereon. An image is printed by the screen printing process on the above-mentioned water-soluble paste layer of the transfer sheet with an ink comprising an inorganic pigment, and a water-insoluble resin film layer comprising a vinyl or cellulose-based resin is provided on the printed ink image.

The image-bearing transfer sheet is immersed into water. The water-soluble paste layer is dissolved in water and the support peels off, whereby there remains an ink-image bearing film member.

The ink-image bearing film member thus obtained is applied to the heat-resistant solid surface such as a ceramic plate, and sintered, whereby the sintered image is fixed to the ceramic product.

According to this method, a large number of ceramic products that bear the same image thereon can be obtained in such a manner that the same image is printed on many transfer sheets by the screen printing, each of the thus prepared ink-image bearing transfer sheets is attached to the surface of the ceramic product, and the image-bearing ceramic products are sintered.

In the screen printing, however, making of a printing plate for forming the ink image includes many steps and requires a great deal of time and labor. The unit cost is necessarily increased, in particular, when various kinds of items are produced, with each item having the same image thereon. Further, the screen printing process is apt to make worse the working conditions due to an air pollution problem caused by the evaporation of organic solvents from the ink employed in the screen printing.

To solve the problems caused by the screen printing process, there is proposed a method of forming a toner image using the electrophotographic process on the same transfer sheet as employed in the above. To be more specific, an image is formed on the transfer sheet using an inorganic toner which comprises an organic polymer, composite particles of an inorganic pigment and glass powder, a binder resin and a pigment for ceramics. In the same manner as stated in the above, the toner image bearing film member is separated from the support of the transfer sheet and attached to the surface of the ceramic product. Then, the toner image thus attached to the ceramic product is sintered, so that the toner image can be easily fixed to the surface of the ceramic product.

The aforementioned method is proposed, for example, in Japanese Laid-Open Patent Applications 4-135798, 7-199540, 7-214890, 7-228037, 7-300382, 8-104050, 8-11496 and 8-119668.

According to the above-mentioned proposed method using the electrophotographic process, the image formation step can be drastically simplified as compared with that by the screen printing process, and various kinds of items, each item having the same image thereon, can be easily manufactured even though the production of each item is on a small-scale.

However, when the toner image prepared by the electrophotographic process is applied to the surface of the ceramic product and sintered, there are the problems that non-transferred spots appear in the sintered toner image and the sintered image is impaired by uneven firing.

SUMMARY OF THE INVENTION

Accordingly, it is therefore a first object of the present invention to provide a method of forming a toner image on an image transfer sheet free from the deposition of toner on the background, for finally obtaining on the surface of a heat-resistant solid an image free of the conventional problems of the appearance of non-transferred spots in an image and the uneven firing of the sintered image. To be more specific, a first object of the present invention is to provide a method of forming a toner image on an image transfer sheet which is designed for decorating fire on the heat-resistant solid surface using a toner which is capable of retaining a chromatic color even after sintered.

A second object of the present invention is to provide a method of fire fixing an image on a heat-resistant solid surface.

A third object of the present invention is to provide a developer for use in the above-mentioned method of forming a toner image on the image transfer sheet.

A fourth object of the present invention is to provide an image transfer sheet bearing thereon a toner image which is prepared by developing a latent electrostatic image to the toner image by the above-mentioned toner image formation method.

The first object or the present invention can be achieved by a method of forming a toner image on an image transfer sheet comprising the steps of forming a latent electrostatic image on an image bearing member, developing the latent electrostatic image formed on the image bearing member to a toner image, using a developer, and transferring the toner image from the image bearing member to an image transfer sheet, the developer (a) comprising a carrier and a toner which comprises a thermoplastic resin and a coloring agent having a chromatic color and being capable of retaining the chromatic color even after the toner is sintered, and (b) satisfying at least one of three conditions that:

(1) a toner concentration in the developer is in a range of 8 to 24 wt. %, (2) the toner has an absolute charge quantity value of 12 $\mu$C/g or less, and (3) a ratio of a true specific gravity of the carrier to that of the toner is in a range of 2 to 3.

In the above-mentioned toner image formation method, it is preferable that the image transfer sheet comprise a support and a water-soluble layer which is provided on the support, and that in the step of transferring the toner image from the image bearing member to the image transfer sheet, the toner image be transferred onto the water-soluble layer of the image transfer sheet, and a resin film layer be provided on the toner image after the toner image is transferred onto the water-soluble layer of the image transfer sheet.

Alternatively, it is preferable that the image transfer sheet comprise a support, a water-soluble layer provided on the support, and a resin layer provided on the water-soluble layer, and that in the step of transferring the toner image from the image bearing member to the image transfer sheet, the toner image be transferred onto the resin layer of the image transfer sheet.

Further, in the step of transferring the toner image from the image bearing member to the image transfer sheet, the toner image may be transferred to the image transfer sheet via an intermediate transfer belt.

In addition, the toner image may be made of at least one color toner selected from the group consisting of a yellow toner, a magenta toner, a cyan toner and a black toner.

The second object of the present invention can be achieved by a method of fire fixing an image on a heat-resistant solid surface comprising the steps of forming a latent electrostatic image on an image bearing member, developing the latent electrostatic image formed on the image bearing member to a toner image, using a developer, the developer (a) comprising a carrier and a toner which comprises a thermoplastic resin and a coloring agent having a chromatic color and being capable of retaining the chromatic color even after the toner is sintered, and (b) satisfying at least one of three conditions that (1) a toner concentration in the developer is in a range of 8 to 24 wt. %, (2) the toner has an absolute charge quantity value of 12 $\mu$C/g or less, and (3) a ratio of a true specific gravity of the carrier to that of the toner is in a range of 2 to 3, transferring the toner image from the image bearing member to an image transfer sheet, attaching the toner image to a heat-resistant solid surface, and sintering the toner image so as to fix the toner image to the heat-resistant solid surface.

The third object of the present invention is achieved by a developer comprising a carrier, and a toner which comprises a thermoplastic resin and a coloring agent having a chromatic color and being capable of retaining the chromatic color even after the toner is sintered, and satisfying at least one of three conditions that:

(1) a toner concentration in the developer is in a range of 8 to 24 wt. %, (2) the toner has an absolute charge quantity value of 12 $\mu$C/g or less, and (3) a ratio of a true specific gravity of the carrier to that of the toner is in a range of 2 to 3.

It is preferable that the coloring agent for use in the above-mentioned toner comprise an alloy pigment.

The fourth object of the present invention can be achieved by a transfer sheet which bears thereon a toner image which is prepared by developing a latent electrostatic image to the toner image, using a developer which comprises a carrier and a toner comprising a thermoplastic resin and a coloring agent having a chromatic color and being capable of retaining the chromatic color even after the toner is sintered, and transferring the toner image to the transfer sheet, the toner image transferred to the transfer sheet satisfying at least one of two conditions that:

(1) the toner image has a glossiness of 6% or more, and (2) the toner image has an image density decreasing ratio of 30% or less.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
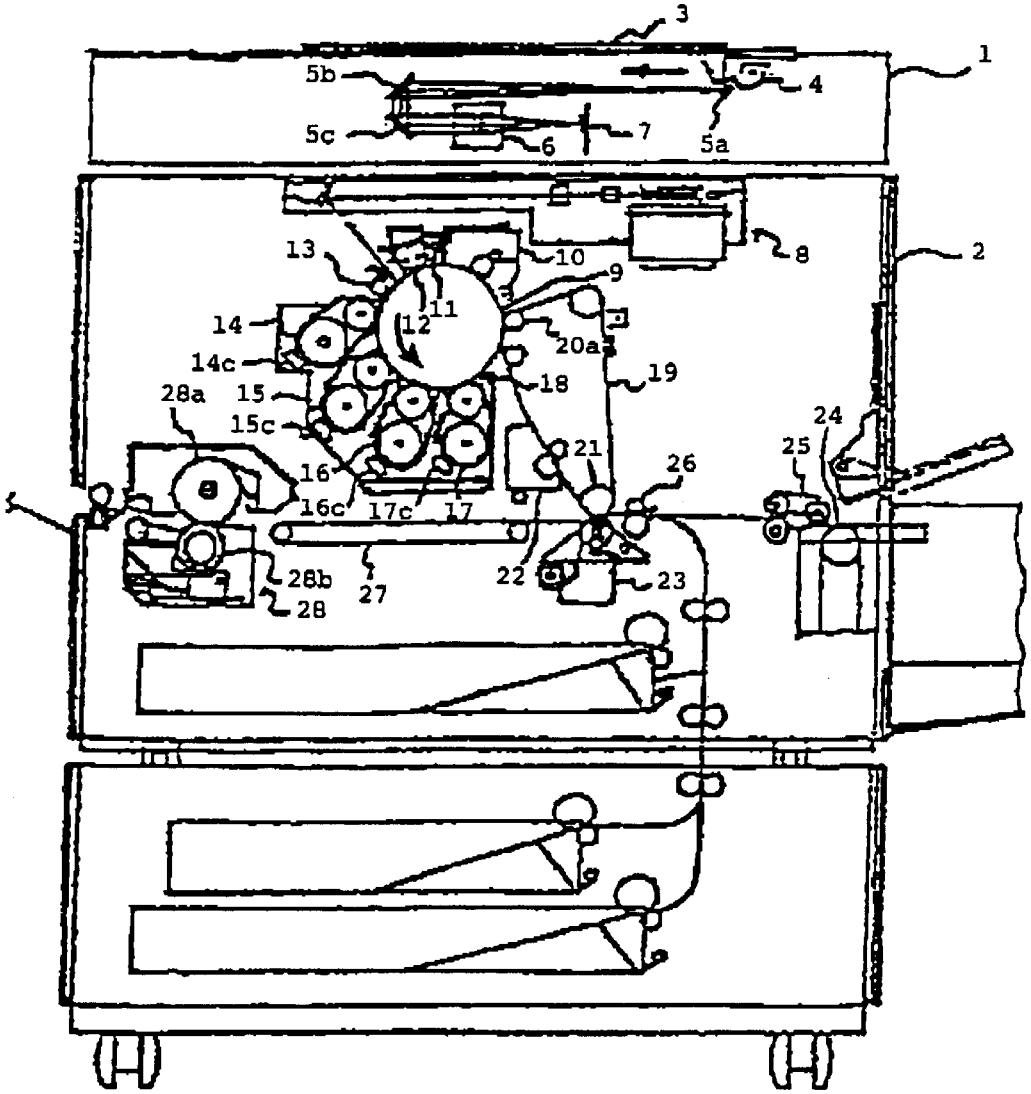
FIG. 1 is a schematic cross-sectional view of an electrophotographic color copying machine for producing a toner image on an image transfer sheet according to the method of forming a toner image by the present invention.

A toner for use in the present invention has a chromatic color and is capable of retaining the chromatic color even after sintered, preferably sintered at 450° C. or more.

The inventors of the present invention have examined the conventional problems with respect to the image fixed to the surface of the heat-resistant solid by the conventional firing method, that is, the problems of appearance of non-transferred spots and uneven firing in the sintered image.

Conventionally, a toner image is formed on an image transfer sheet using a toner capable of being retaining a chromatic color even after sintered, and a resin film layer is provided on the toner image. Then, a toner image bearing resin film layer is peeled away from the support of the image transfer sheet, and attached to the surface of a heat-resistant solid such as a ceramic product. Then, the toner image is fixed to the solid surface by the application of heat thereto. When the temperature is in the range of 200 to 400° C. in the course of the sintering step, non-transferred minute spots tend to appear in the sintered image fixed to the heat-resistant solid surface and uneven firing tends to occur.

Those conventional problems are considered to result from minute air gaps which are present in toner particles constituting a toner image which is prepared by the electrophotographic process. Because of the presence of the minute air gaps in the toner image layer, bumping takes place when the toner image is sintered, thereby causing the above-mentioned problems.

Namely, when the temperature is in the range of 200 to 400° C. in the sintering step, the thermoplastic resin contained in the toner image and the resin film layer which bears the toner image thereon change from a solid state to a liquid state, with the viscosity thereof being lowered, so that the air space between the toner particles constituting the toner image swell. Or when the toner image bearing resin film layer is peeled from the support of the image transfer sheet by immersing the toner image bearing image transfer sheet in water, water penetrates into the minute gaps in the toner image layer, and thereafter evaporates to swell the gap in the sintering step. Thus, the above-mentioned bumping phenomenon is considered to occur.

Further, the inventors have studied the reason why the above-mentioned minute gaps are generated in the toner image layer composed of the toner particles formed on the image transfer sheet. As a result, it has been confirmed that toner particles with the same polarity are superimposed in a toner image area, and those toner particles electrically repel each other to generate the air gap.

When a toner image is formed on an image bearing member such as an electrophotographic photoconductor, the electrical repellent force between the toner particles constituting the toner image is generally controlled by the electric potential of background of the photoconductor. However, when the toner image is transferred onto an intermediate transfer belt or an image transfer sheet, the air gaps are increased in the toner image because of the electrical repellent force between the toner particles with the same polarity is not reduced by the background potential.

Although the number of air gaps in the toner image can be considerably decreased when the toner image is fixed to the image transfer sheet or intermediate transfer belt by the application of heat and pressure thereto using an image-fixing roller, it is effective to minimize the air gaps between the toner particles transferred to the image transfer sheet or the intermediate transfer belt before those toner particles are fixed thereto.

With the above-mentioned findings taken into consideration, the conventional problems can be solved by using a developer which satisfies at least one of three conditions that:

(1) a toner concentration in the developer is in a range of 8 to 24 wt. %, (2) the toner has an absolute charge quantity value of 12 $\mu$C/g or less, and (3) a ratio of a true specific gravity of the carrier to that of the toner is in a range of 2 to 3.

When a toner image is formed on the image transfer sheet using the above-mentioned developer, the air gaps in the toner particles constituting the toner image can be reduced when the toner image is transferred to the image transfer sheet, and then further minimized when the transferred toner image is fixed thereto under the application of heat and pressure. Thus, the use of such a developer as mentioned above makes it possible to fix to the heat-resistant solid surface a high quality toner image without any non-transferred spots or uneven firing.

When the toner concentration in the developer is less than 8 wt. %, there easily appear non-image-transferred spots in the sintered image fixed to the heat-resistant solid and the sintered image is easily impaired by uneven firing. On the other hand, when the toner concentration exceeds 24 wt. %, the background of the image transfer sheet may be stained with the toner particles.

It is particularly preferable that the toner concentration in the developer of the present invention be in a range of 10 to 20 wt. %.

To adjust the toner concentration to 8 to 24 wt. %, the toner and the carrier in the predetermined amounts are mixed with stirring using a turbo-mixer or a ball mill. Further, as the thus prepared developer is repeatedly subjected to copying operation, the toner is gradually consumed and the toner concentration is lowered. Therefore, the toner component may be replenished in the developer so as to maintain the toner concentration in the range of 8 to 24 wt. % by appropriately detecting the toner concentration in a developer unit using various sensors.

With respect to the above-mentioned condition (2), when the toner with an absolute charge quantity value of 12 $\mu$C/g or less, preferably 10 $\mu$C/g or less, is employed for the developer of the present invention, there is scarcely observed non-transferred spots or uneven firing in the sintered image on the surface of the heat-resistant solid. In addition, the absolute charge quantity value of toner is preferably 4 $\mu$C/g or more because the toner deposition on the background of the transfer sheet can be effectively reduced.

The absolute charge quantity value of toner can be controlled to 12 $\mu$C/g or less, for instance, by decreasing the amount of charge control agent or additive such as hydrophobic silica, which may be generally added to the toner, by increasing the toner concentration in a two-component developer, or by moderating a load applied to the toner in the stirring operation or curtailing the stirring time when the developer is first prepared or when the developer is stirred in a developer unit.

With respect to the condition (3), when the ratio of a true specific gravity of the carrier to that of the toner is 2 or more, the toner deposition amount on the image transfer sheet becomes proper, and consequently, the toner image can be fixed to the heat-resistant solid surface without non-transferred spots or uneven firing. When the above-mentioned ratio of the true specific gravity exceeds 3, the background of the image transfer sheet is easily stained with the toner deposition. In particular, it is preferable that the ratio of the true specific gravity of the carrier to that of the toner be in a range of 2.2 to 2.6.

The ratio of the true specific gravity of the carrier to that of the toner can be controlled by the following method. The true specific gravity of toner is almost determined by the specific gravities of a resin and a coloring agent for use in the toner composition and the mixing ratio thereof. For example, the true specific gravity of toner widely varies in the range of about 1.5 to 5 depending on the specific gravity and the content of the coloring agent; while the true specific gravity of carrier is about 5.6 ±1. The reason why a variation of the true specific gravity of carrier is very small is that a resin film layer coated on carrier particles cannot be extremely thickened so as to prevent the so-called spent toner. In light of the above-mentioned each specific gravity of the toner or carrier, the ratio of the true specific gravity of carrier to that of toner may be adjusted by controlling the specific gravity and the content of the coloring agent in the toner.

To be more specific, it is preferable to employ an alloy pigment to be described later as the coloring agent for use in toner and to control the weight ratio of the resin to the alloy pigment in a range of about 3:7.

The above-mentioned charge quantity of toner and the toner concentration in the developer can be measured by the blow-off method.

Figure 3:
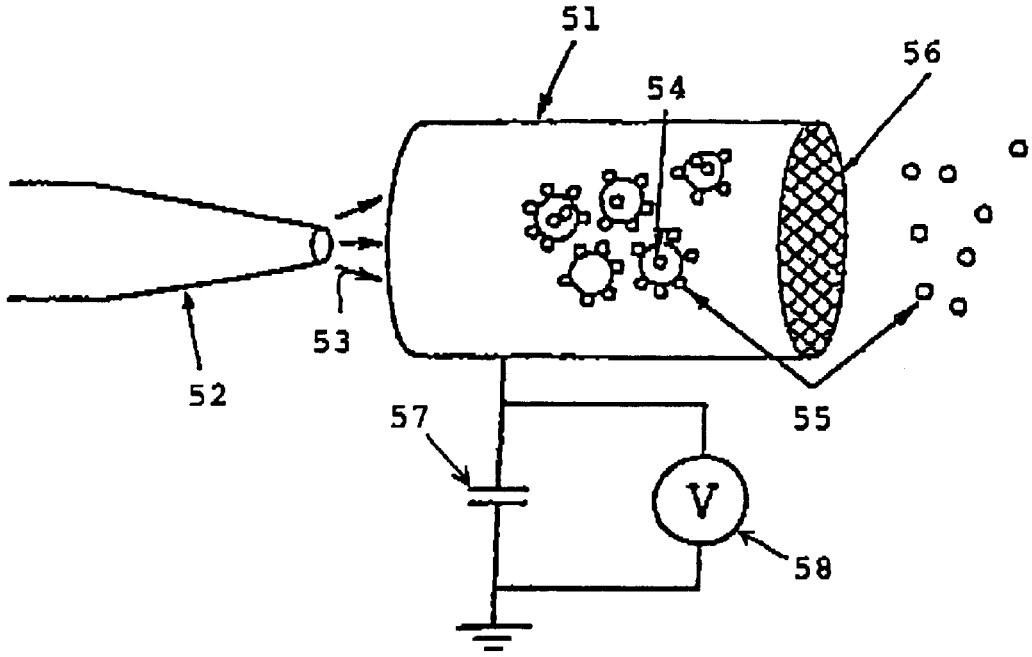
FIG. 3 is a schematic diagram in explanation of the blow-off method for measuring the toner concentration and the charge quantity of toner.

FIG. 3 is a schematic diagram of the instrument for measuring the charge quantity and the toner concentration by the blow-off method.

A two-component developer comprising toner particles 55 and carrier particles 54, for example, about 2 to 3 g of the developer taken out of the copying machine, is placed into a blow-off gauge 51, and a nozzle 52 which is driven in rotation is caused to eject a nitrogen gas 53 onto the developer in the blow-off gauge 51. By the blow of nitrogen gas 53, a toner particle 55 is separated from a carrier particle 54 and gets out of the blow-off gauge 51 through a wire net 56. At that time, a condenser 57 is charged by the electric charge remaining on the carrier particles 54 (of which charge quantity is the same as that of the toner particles 55 escaping from the blow-off gauge 51), so that the voltage applied to the condenser 57 increases. The increase in voltage may be measured using a potentiometer 58.

The charge quantity per unit weight of toner can be obtained by dividing the total charge quantity ($\mu$C) charged into the condenser 57 by the weight (g) of the toner particles which are moved out of the blow-off gauge 51.

Even when a one-component developer is used in the present invention, the appropriate carrier may be selected so as to show the previously mentioned charge quantity of toner.

The toner concentration in the developer can be obtained by measuring the total weight (X) of the developer before the developer is subjected to the blow-off method, and in addition, measuring the weight (Y) of the toner particles escaping from the blow-off gauge 51. Then, the toner concentration is obtained in accordance with the following formula:

$$\text{Toner concentration (wt. \%)}=(Y/X)\times 100$$

The true specific gravities of the carrier and the toner can be measured in accordance with JIS Z 6807, and the thus obtained true specific gravity of the carrier may be divided by the true specific gravity of the toner, thereby obtaining the ratio of the true specific gravity of carrier to that of toner.

Furthermore, the inventors of the present invention have paid attention to the toner image formed on the image transfer sheet in order to obtain on the heat-resistant solid surface an image free of non-transferred spots or uneven firing after the toner image bearing image transfer sheet is attached to the heat-resistant solid and sintered. As a result, the above-mentioned purpose can be accomplished when the toner image transferred to the image transfer sheet satisfies at least one of two conditions that:

(1) the toner image has a glossiness of 6% or more, and (2) the toner image has an image density decreasing ratio of 30% or less.

Further, it is confirmed that fire fixing of a toner image onto the heat-resistant solid surface can be more preferably carried out when the toner image transferred to the image transfer sheet has a voidage of 20% or less.

Although it is not always necessary that both the conditions with respect to the toner image bearing image transfer sheet and the previously mentioned conditions with respect to the developer for forming a toner image on the image transfer sheet be satisfied at the same time, the most preferable results can be obtained after the fire fixing of a toner image on the heat-resistant solid when both conditions are satisfied.

When a resin film layer is provided on the toner image layer transferred to the image transfer sheet, the measurement of the glossiness and the image density decreasing ratio of the toner image may be carried out before the provision of the resin film layer. The resin film layer to be provided on the toner image may comprise a sublimable dye so as to colour the obtained resin film layer in the interest of convenience of the film forming process. Therefore, the glossiness and image density of the toner image cannot be exactly measured after the resin film layer is coated on the toner image.

In the case where the image transfer sheet comprises a resin layer and a toner image is transferred onto the resin layer, the glossiness and image density of the toner image may be evaluated just after the image transfer.

The toner image capable of satisfying the above-mentioned conditions (1) and/or (2) can be obtained on the image transfer sheet not only by employing the previously mentioned developer according to the present invention when the toner image is formed, but also by controlling the image fixing conditions.

To be more specific, the toner image transferred to the image transfer sheet is fixed thereto using an image fixing roller in the electrophotographic copying machine or printer. It is effective to increase the temperature of the image fixing roller or decrease the linear speed of the image fixing roller while passing through the transferred toner image. For instance, in the case where the image fixing of toner image is generally carried out at about 160° C. in the copying machine or printer, this image fixing temperature may be increased to about 180° C. Alternatively, when the image fixing roller is generally moved at a linear speed of about 180 mm/sec, the linear speed may be decreased to about 90 mm/sec. Further, the pressure applied to the toner image in the image fixing process may be increased.

In addition, the conditions (1) and (2) with respect to the toner image transferred to the image transfer sheet can be easily satisfied by increasing the amount ratio of thermoplastic resin contained in the toner or employing a thermoplastic resin with improved image fixing properties.

As previously mentioned, it is preferable that the glossiness of the toner image transferred to the image transfer sheet be 6% or more, more preferably 7% or more, and further preferably 8% or more. When there are minute gaps between the toner particles constituting a toner image, the gloss of the toner image decreases because of scattering of light at the interface between the toner particle and the air space. When the toner image with a glossiness of 6% or more is formed on the image transfer sheet, the sintered image without non-transferred spots or uneven firing can be fixed onto the heat-resistant solid surface after the toner image is sintered.

The glossiness (%) of a toner image portion is measured at an incident angle of 60° using a commercially available variable glossmeter made by Nippon Denshoku Kogyo Co., Ltd. In this case, a toner image portion which is coated with a toner at a coating ratio of 90% or more per unit area, that is, a substantially solid image formed on the image transfer sheet is subjected to measurement. The toner-coating ratio per unit area is measured using a commercially available high-speed color image analyzer "Image Analyzing System SPICCA" (Trademark), made by Nippon Avionics Co., Ltd.

The previously mentioned image density decreasing ratio (%) of a toner image is measured using a commercially available automatic friction abrasion analyzer made by Kyowa Interface Science Co., Ltd. To obtain the image density decreasing ratio, the initial image density ($ID_{in}$) of a toner image immediately after transferred to the image transfer sheet is measured using McBeth densitometer. Then, a plane-contact type image-painting jig of the friction abrasion analyzer is brought into contact with the surface of the toner image by the application of a load of 500 g thereto, and the image-painting Jig is caused to move on the toner image at a speed of 1.0 mm/s with a stroke of 10 mm. The image density ($ID_{af}$) of the toner image is then measured using the same McBeth densitometer.

The image density decreasing ratio is obtained in accordance with the following formula:

$$\text{Image Density Decreasing Ratio } (\%) = [-(ID_{af})/(ID_{in})] \times 100$$

Further, as mentioned above, it is preferable that the voidage (%) of a toner image formed on the image transfer sheet be 20% or less, and more preferably 5% or less. In this case, the size of a void formed in the toner image is preferably about 30 μm or less.

The voidage (%) of a toner image transferred to the image transfer sheet can be obtained in such a manner that a section of the toner image is observed with a reflection type microscope with an optical lens at a magnification of 1,000×, and the section image thus observed is read into the commercially available high-speed color image analyzer "Image Analyzing System SPICCA" (Trademark), made by Nippon Avionics Co., Ltd., and the section image is subjected to two-valued image processing. Thus, the voidage (%) of the toner image can be obtained. In this case, the section of the toner image is observed at least at 30 points, and the average value of the voidage may be obtained.

In the interest of accuracy, the previously mentioned image glossiness, image density decreasing ratio and the voidage of the toner image are measured at three positions in a toner image, that is, at the first top position, the center position, and the last end position of the toner image, in terms of the position through which the image fixing rolled is caused to pass.

In order to obtain an image free of non-transferred spots and uneven firing on the surface of the heat-resistant solid after the toner image bearing heat-resistant solid is subjected to firing, the third attention is paid to the respective resins contained in the image transfer sheet and the toner image formed on the image transfer sheet, and the sintering conditions.

The conventional image transfer sheet comprises a support and a water-soluble layer formed thereon comprising a water-soluble material. After a toner image is formed on the water-soluble layer of the image transfer sheet, the toner image bearing water-soluble layer is peeled from the support by impregnating at least the boundary between the support and the water-soluble layer with water. Then, the toner image bearing water-soluble layer is attached to the surface of a heat-resistant solid, followed by sintering at high temperature. Other components than inorganic materials for use in the toner are sintered; while the inorganic materials remain as an image after the sintering step.

However, in the above-mentioned conventional steps, there are the problems that the toner image bearing water-soluble layer tends to collapse after separating from the support of the image transfer sheet and the toner image bearing water-soluble layer cannot be easily attached to the heat-resistant solid surface. To solve those problems, the following methods (1-1, 1-2, 2-1 and 2-2) using a resin film layer (or resin layer) are considered to be effective.

(1) There is employed an image transfer sheet comprising a support and a water-soluble layer formed thereon. After forming a toner image on the water-soluble layer of the image transfer sheet, a resin film layer is provided on the toner image, and thereafter the resin film layer and the toner image are separated together from the support of the image transfer sheet by dissolving the water-soluble layer, thereby obtaining a toner image bearing film member.

1-1: After that, the above-mentioned toner image bearing film member is closely attached to the surface of the heat-resistant solid in such a direction that the toner image comes in contact with the heat-resistant solid surface.

1-2: After that, the above-mentioned toner image bearing film member is closely attached to the surface of the heat-resistant solid in such a direction that the resin film layer comes in contact with the heat-resistant solid surface.

(2) There is employed an image transfer sheet comprising a support, and a water-soluble layer and a resin layer which are successively overlaid on the support in this order. A toner image is formed on the resin layer of the image transfer sheet, and thereafter the resin layer and the toner image are separated together from the support of the image transfer sheet by dissolving the water-soluble layer, thereby obtaining a toner image bearing film member.

1-1: After that, the above-mentioned toner image bearings film member is closely attached to the surface of the heat-resistant solid in such a direction that the toner image comes in contact with the heat-resistant solid surface.

1-2: After that, the above-mentioned toner image bearing film member is closely attached to the surface of the heat-resistant solid in such a direction that the resin layer comes in contact with the heat-resistant solid surface.

As mentioned above, the resin layer is effective to solve the conventional problems. Therefore, a resin film can be used as the image transfer sheet, or the image transfer sheet may comprise a support and a resin layer formed thereon.

However, it has been recognized that the resin layer produces another problem. Namely, while the toner image bearing heat-resistant solid is subjected to firing, both a thermoplastic resin component contained in the toner image and a resin component for use in the resin film layer change from a solid state to a liquid state as decreasing the viscosity, and finally the resin components are sintered in the sintering step. In such a sintering step, if one resin component that is in contact with the heat-resistant solid surface, namely, the thermoplastic resin for use in the toner image or the resin component for use in the resin film layer, is sintered earlier than the other resin component that is not in contact with the solid surface, the bumping phenomenon takes place, and consequently, non-transferred spots and uneven firing appear in the sintered image obtained on the heat-resistant solid surface.

In general, a heat source for firing the toner image bearing heat-resistant solid is situated on the wall of an oven. Therefore, it is supposed that the toner image bearing heat-resistant solid is supplied with radiant heat from the outer side of the toner image bearing film member, that is, the resin film layer side or the toner image layer side. In practice, however, because the heat-resistant solid can accumulate a large amount of heat, the heat energy conducts from the heat-resistant solid to the toner image bearing film member. Therefore, the above-mentioned bumping phenomenon is supposed to often take place.

As a result of intensive study, it is confirmed that the bumping problem can be effectively eliminated by attaching the toner image bearing film member to the heat-resistant solid surface in such a direction that any of the toner image side or the resin film layer side that comprises a resin component with a higher sintering temperature is brought into contact with the surface of the heat-resistant solid, and sintering the toner image bearing film member.

For instance, in the case where a toner image is formed on a water-soluble layer of the image transfer sheet, and a resin film layer is provided on the toner image, the resin film layer and the toner image are separated together from the support of the image transfer sheet to form a toner image bearing film member. The toner image bearing film member is attached to the heat-resistant solid surface in such a direction that when the thermoplastic resin of the toner image has a higher sintering temperature than that of the resin film layer, the toner image comes in contact with the heat-resistant solid surface, while when the resin film layer has a higher sintering temperature than that of the thermoplastic resin of the toner image, the resin film layer comes into contact with the heat-resistant solid surface.

On the other hand, when a toner image is formed on a resin layer of the image transfer sheet, the resin layer and the toner image are separated together from the support of the image transfer sheet to form a toner image bearing film member. The toner image bearing film member is attached to the heat-resistant solid surface in such a direction that when the thermoplastic resin of the toner image has a higher sintering temperature than that of the resin layer, the toner image comes in contact with the heat-resistant solid surface, while when the resin layer has a higher sintering temperature than that of the thermoplastic resin of the toner image, the resin layer comes into contact with the heat-resistant solid surface.

Thus, occurrence of bumping can be minimized, so that a clear image can be fixed to the solid surface through the sintering step.

The materials constituting the developer of the present invention and the materials for use in the above-mentioned resin film layer will be described in detail.

The toner for use in the present invention comprises a thermoplastic resin and a coloring agent such as a pigment for ceramic use which has a chromatic color and is capable of retaining the chromatic color. It is preferable that the pigment comprise a metallic oxide.

Examples of the metal element for forming the above-mentioned metallic oxide are Cu, Ag and Au belonging to the group I in the periodic table; Cd belonging to the group II; Ti belonging to the group IV; V and Sb belonging to the group V; Se, Cr, Mo, W and U belonging to the group VI; Mn belonging to the group VII; and Fe, Co, Ni, Ir and Pt belonging to the group VIII. The mixture of the above-mentioned metallic oxides can also be used for the pigment.

As the coloring agent contained in the toner for use in the present invention, a pigment prepared by mixing a plurality of the above-mentioned metallic oxides and melting the mixture at a temperature in the range of 1,000 to 1,200° C. is particularly preferable. The thus prepared pigment will be hereinafter referred to as an alloy pigment.

In general, the absorptivity coefficient of the conventional pigment for ceramics is low. Therefore, in order to obtain a full-color image with high image density using the toner comprising the above-mentioned conventional pigment for ceramics, it is required to increase the toner deposition amount.

In contrast to the above-mentioned conventional pigment for ceramics, the alloy pigment shows high absorptivity coefficient. Therefore, when such an alloy pigment is used as the coloring agent for the toner, it is possible to form a full-color image with high image density at a small deposition amount of toner.

Further, the degree of pigmentation of the alloy pigment is increased. This is because the orbit d of a metal element is split by the influence of a plurality of metals, and consequently, the number of electron-transferrable orbits is increased, with the result that the apparent oscillator strength is increased.

As a binder resin for use in the toner, it is particularly preferable to employ a thermoplastic resin with a sintering temperature in the range of 280 to 360° C., a glass transitional point in the range of 50 to 70° C., a softening point in the range of 65 to 80° C., and a flow-initiating point in the range of 80 to 130° C.

Any binder resins that are employed in the conventional toners are usable in the present invention.

Examples of such binder resins include polyester, polystyrene, polyethylene, polyamide, epoxy resin, epoxy polyol resin, and terpene resin. To be more specific, there can be employed a polystyrene resin, a styrene-methyl acrylate copolymer resin, a styrene-ethyl acrylate copolymer resin, and styrene-n-butyl copolymer resin. These resins can be employed alone or in combination.

It is preferable that the amount ratio of the binder resin in the toner be in the range of 10 to 50 wt % of the total weight of the toner.

It is preferable that the toner for use in the present invention further comprise a fritted glaze in combination with the above-mentioned coloring agent and thermoplastic resin. In this case, the coloring agent such as a pigment and the fritted glaze may be merely mixed. Alternatively, a mixture of the pigment and the fritted glaze may be fused under application of heat thereto, and cooled and pulverized to prepare a pulverized material, The thus obtained pulverized material may be used as the coloring agent.

In particular, it is preferable to employ a coloring agent which is prepared by mixing the alloy pigment and the fritted glaze in predetermined amounts, fusing the mixture at 650 to 800° C., and thereafter cooling and pulverizing the mixture. By employing the toner comprising the above prepared coloring agent, a clear full-color image with high image density can be formed on the image transfer sheet even though the toner deposition amount is small. Finally, when the thus prepared toner-image bearing transfer sheet is attached to the heat-resistant solid surface such as a ceramic product and sintered, a sintered image with high image density can be clearly formed on the heat-resistant solid surface.

In the toner composition, it is preferable that the amount ratio by weight of the coloring agent such as a pigment to the fritted glaze be in the range of 2/8 to 6/4, more preferably in the range of 3/5 to 5/5. When the amount ratio of the coloring agent to the fritted glaze is within the above-mentioned range, the degree of pigmentation of the toner is sufficient, and the sintered image can be prevented from peeling away from the surface of the heat-resistant solid.

The fritted glaze for use in the toner is melted or semi-melted during the sintering step, and thereafter completely solidified when cooled to room temperature, whereby the fritted glaze serves to sinter the coloring agent contained in the toner so as to fix the coloring agent to the heat-resistant solid surface.

Examples of the base material for the fritted glaze include a hydroxide of alkali metal or alkaline earth metal, such as lithium hydroxide; a carbonate of alkali metal or alkaline earth metal, such as lithium carbonate; a chloride of alkali metal or alkaline earth metal and aluminum chloride; boric acid and a borate of alkali metal or alkaline earth metal; a metaborate of alkali metal or alkaline earth metal: a phosphate of alkali metal or alkaline earth metal; a pyrophosphate of alkali metal or alkaline earth metal; a silicate of alkali metal or alkaline earth metal; a metasilicate of alkali metal or alkaline earth metal; zirconium silicate; bone ash; borax; ammonium metavanadate; metallic oxides such as tungsten oxide, vanadium pentoxide, tin oxide, zirconium oxide, cerium oxide, and molybdenum oxide; metallic fluorides such as calcium fluoride and aluminum fluoride; and glasslet. These materials can be used alone or in combination.

In order to enhance the bonding between the fritted glaze and the pigment, feldspar such as lime feldspar, potash feldspar, soda feldspar or petalite (lithium feldspar), kaolin, silica, alumina, quartz, titanium oxide, chamotte, natural minerals such as earth and ash, limestone, magnesite, talc, and dolomite, barium carbonate, zinc oxide, and strontium carbonate can be employed. These materials may be mixed with the fritted glaze and the pigment in advance, and the obtained mixture may be melted, and thereafter added to the toner composition.

The toner for use in the present invention may further comprise a charge control agent. As such a charge control agent, there can be employed any of the conventional charge control agents, for example, nigrosine dyes, quaternary ammonium salts, chromium-containing dyes, zinc-containing dyes, iron-containing dyes, molybdic acid chelate pigments, and fluorine-modified quaternary ammonium salts. These charge control agents may be selected depending upon the polarity of the desired toner.

The amount of charge control agent to be added to the toner composition depends upon the kind of thermoplastic resin, the presence or absence of an additive which may be contained in the toner composition when necessary, and also upon the producing method of the toner including the dispersion process. It is proper that the amount of charge control agent be in the range of 0.1 to 10 parts by weight, and more preferably 2 to 6 parts by weight, to 100 parts by weight of the thermoplastic resin.

When the amount of charge control agent is within the above-mentioned range, the charge quantity of the toner is sufficient, so that scattering of toner particles and the toner deposition on the background can be prevented. At the same time, the electrostatic attraction of the toner to the carrier is proper, so that the increase in fluidity of the developer can be prevented and the decrease in image density can be reduced.

Also, other conventional additives, for example, an agent for improving the toner fluidity such as hydrophobic silica, zinc stearate, aluminum stearate or titanium oxide, may be added to the toner composition for use in the present invention.

As the carrier for forming a two-component developer, the conventional carrier particles, such as iron particles, ferrite particles, and glass beads can be employed. Those carrier particles may be coated with a resin, such as polycarbon fluoride, polyvinyl chloride, polyvinylidene chloride, phenolic resin, polyvinyl acetal or silicone resin.

As the image transfer sheet, any member that can bear a toner image thereon is usable in the present invention. For instance, as previously mentioned, an image transfer sheet comprising a support and a water-soluble layer formed thereon can be used. The above-mentioned image transfer sheet may further comprise a resin layer which is provided on the water-soluble layer. Further, a resin film or a sheet comprising a support and a resin layer formed thereon are also usable.

The water-soluble layer for use in the image transfer sheet comprises a water-soluble material such as dextrin or polyvinyl alcohol.

Further, the toner image bearing film member comprises a toner image and a resin film, and it is preferable that the thermoplastic resin of the toner image have a sintering temperature lower than that of the resin film.

The resin layer for use in the image transfer sheet or the resin film layer coated on the toner image may have a sintering temperature of 330 to 530° C.

Specific examples of the resin for use in the resin layer or the resin film layer include butyral resin, polyvinylidene chloride resin, polyacrylonitrile resin, and polystyrene resin.

The sintering temperature of a resin is measured by differential thermogravimetry. In the present invention, measurement is carried out in a TG-DTA mode using a commercially available thermal analysis equipment "DSC3200" (Trademark), made by MAC Science Co., Ltd., or a commercially available differential thermogravimetric analysis equipment "Differential Thermobalance TGD-3000" (Trademark), made by Sinkuriko, Inc.

In the present invention, toner images are formed on the image transfer sheet by the conventional electrophotographic process using a conventional monochrome or full-color copying machine or printer.

In particular, when a character image is formed on the heat-resistant solid surface, writing of a toner image may be reversed in order to avoid the formation of a mirror image on the heat-resistant solid surface.

An example of a method of forming an image and fire fixing the same on a heat-resistant surface of the present invention will now be explained with reference to the accompanying drawings.

The method of forming an image and fire fixing the image on a heat-resistant surface of the present invention comprises the steps of (1) forming a toner image by electrophotography on an image transfer sheet comprising a support and a resin layer formed thereon, provided that when the image transfer sheet does not include the resin layer, a step of providing the resin film layer on the toner image is included, (2) peeling the toner image and the resin layer (or resin film layer) together away from the support to prepare a toner image bearing film member, (3) applying the toner image bearing film member to a heat-resistant solid surface, and (4) fire fixing the toner image to the heat-resistant solid surface by sintering the toner image bearing film member.

FIG. 1 is a schematic cross-sectional view of an electrophotographic color copying apparatus for use in the present invention.

Figure 2:
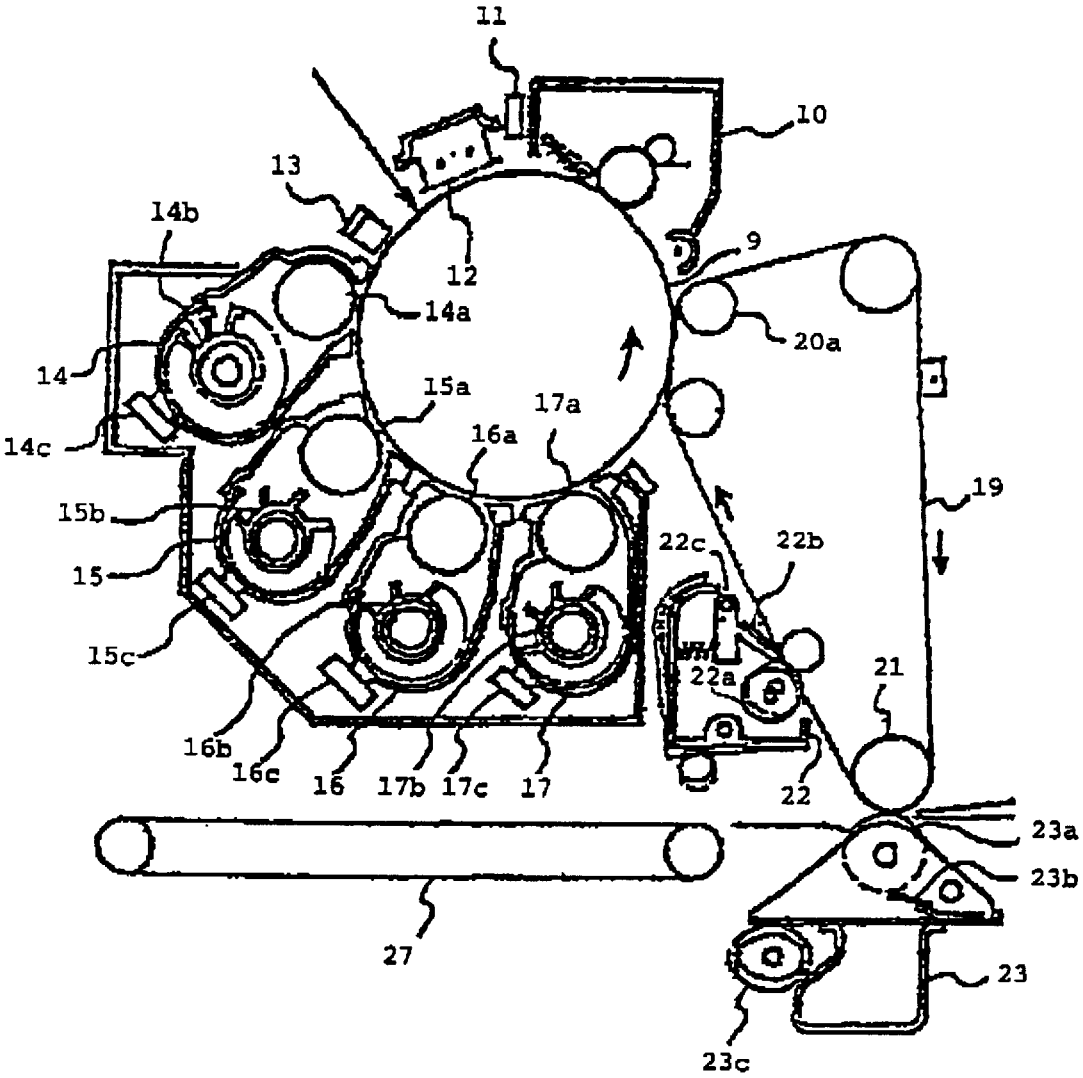
FIG. 2 is a partially sectional view of a photoconductor and an intermediate transfer belt unit that may be incorporated in FIG. 1.

FIG. 2 is a schematic cross-sectional view of an electrophotographic photoconductor, parts disposed around the photoconductor, and an intermediate belt unit of the electrophotographic color copying apparatus shown in FIG. 1.

In FIG. 1, a color image reading unit 1 forms an image corresponding to an image of an original document 3 on a color sensor 7, using a radiation lamp 4, a group of mirrors 5*a*, 5*b* and 5*c*, and a lens 6, and reads a color image information of the image formed on the color sensor 7, with respect to each color separation light information such as blue, green and red (hereinafter referred to as B, G and R, respectively), and converts each color separation light information to an electric color separation image signal. Based on the intensity level of each color separation image signal of B, G and R, each color separation image signal is subjected to color conversion processing, using an image processing unit (not shown), whereby color data of black, cyan, magenta and yellow (hereinafter referred to as Bk, C, M and Y, respectively) are obtained.

By use of the color data, a full-color toner image is formed on an image transfer sheet as follows:

In a color image recording unit 2 shown in FIG. 2, an electrophotographic photoconductor 9 is rotated counterclockwise in the direction of the arrow. Around the electrophotographic photoconductor 9, there are disposed, for instance, a photoconductor cleaning unit 10 for cleaning the surface of the photoconductor 9, including a cleaning pre-quenching device (not shown), a quenching lamp 11, a charger 12, a potential sensor 13, a black development unit 14, a cyan development unit 15, a magenta development unit 16, a yellow development unit 17, an optical sensor 18 for detecting developed density patterns, and an intermediate image transfer belt 19.

Each of the above-mentioned development units 14 to 17 is composed of, for instance, a development sleeve (14*a*, 15*a*, 16*a*, 17*a*) which is rotated and brings a crest of a developer into contact with a surface of the photoconductor 9 for developing a latent electrostatic image formed on the surface of the photoconductor 9 to a toner image, a development paddle (14*b*, 15*b*, 16*b*, 17*b*) which is rotated for scooping up and mixing the developer, a toner concentration sensor (14*c*, 15*c*, 16*c*, 17*c*) for detecting the concentration of the toner contained in the developer as shown in FIGS. 1 and 2.

In each of the development units 14 to 17, there is filled a developer (a) comprising a carrier and a toner which comprises a thermoplastic resin and a coloring agent having a chromatic color and capable of retaining the chromatic color even after the toner is sintered, and (b) satisfying at least one of three conditions that:

(1) a toner concentration in the developer is in a range of 8 to 24 wt. %, (2) the toner has an absolute charge quantity value of 12 $\mu$C/g or less, and (3) a ratio of a true specific gravity of the carrier to that of the toner is in a range of 2 to 3.

A black image data is input to the color image recording unit 2. A writing-in optical unit 8 converts the black image data into a corresponding optical signal, and optical writing is performed, using a laser beam based on the optical signal, on a charged surface of the electrophotographic photoconductor 9, so that a latent electrostatic image corresponding to the black image is formed on the surface of the electrophotographic photoconductor 9, for instance, with a potential of −80 V to −130 V in an image area thereof and a potential of −500 V to −700 V in a non-image area thereof.

The latent electrostatic image corresponding to the black image is developed with a black toner placed on the development sleeve 14*a* which has begun to be rotated before a leading edge of the latent electrostatic image reaches a development position of the black development unit 14, whereby a black toner image is formed on the surface of the electrophotographic photoconductor 9. When a rear edge of the latent electrostatic image has passed over the development position, the black development unit 14 is moved to an inoperative position.

The black toner image formed on the surface of the electrophotographic photoconductor 9 is then transferred to a surface of the intermediate image transfer belt 19 which is driven in rotation at the same peripheral speed as that of the photoconductor 9.

The transfer of the black toner image from the photoconductor 9 to the intermediate image transfer belt 19 is carried out with the application of a predetermined bias voltage to an image transfer bias roller 20*a* while the photoconductor 9 is kept in contact with the intermediate image transfer belt 19.

After the black toner image is transferred to the intermediate image transfer belt 19, the surface of the electrophotographic photoconductor 9 is cleaned by use of the photoconductor cleaning unit 10, then uniformly charge-quenched by the quenching lamp 11, and then uniformly charged by the charger 12.

A cyan image data is then input to the color image recording unit 2. The writing-in optical unit 8 converts the cyan image data into a corresponding optical signal, and optical writing is performed on the charged surface of the electrophotographic photoconductor 9, using a laser beam based on the optical signal, so that a latent electrostatic image corresponding to the cyan image is formed on the surface of the electrophotographic photoconductor 9.

The latent electrostatic image corresponding to the cyan image is developed with a cyan toner by the cyan development unit 15 in the same manner as in the development of the latent electrostatic image corresponding to the black image by the black development unit 14, whereby a cyan toner image is formed on the surface of the electrophotographic photoconductor 9.

The cyan toner image formed on the surface of the electrophotographic photoconductor 9 is then transferred to the surface of the intermediate image transfer belt 19 in the same position as that of the black toner image which is already transferred thereto.

Thereafter, a magenta toner image and a yellow toner image are successively transferred to the intermediate image transfer belt 19 in the same position as that of the previously transferred black and cyan toner images in the same manner as mentioned above, whereby a full-color toner image is formed on the surface of the intermediate image transfer belt 19.

The full-color toner image formed on the intermediate image transfer belt 19 is then transferred to an image transfer sheet by an intermediate image transfer belt unit which will now be explained.

As shown in FIG. 2, the intermediate image transfer belt 19 passes over a drive roller 21, an image transfer bias roller 20*a* and a group of driven rollers, and controlled with respect to the driving thereof by a drive motor, As the material for the intermediate image transfer belt 19, there can be employed, for instance, a carbon-dispersed fluoroplastics such as ethylene tetrafluoroethylene (ETFE) with a volume resistivity of $10^{10}$ Ωcm and a surface resistivity of $10^{9}$ Ωcm.

The image transfer bias roller 20*a* can be fabricated, for instance, by covering a hydrin rubber roller with a PFE tube so as to have a volume resistivity of $10^{9}$ Ωcm.

A belt cleaning unit 22 is composed of a brush roller 22*a*, a rubber blade 22*b* and a detaching mechanism 22*c* for detaching the brush roller 22*a* and the rubber blade 22*b* from the surface of the intermediate image transfer belt 19 while each of the above-mentioned color toner images is being transferred to the belt 19.

Each color toner image is successively transferred to the right position of the intermediate image transfer belt 19 accurately, whereby a full-color toner image is formed on the belt 19.

An image transfer unit 23 for transferring the toner image from the intermediate image transfer belt 19 to an image transfer sheet 24 is composed of, for instance, an image transfer bias roller 23*a*, a roller cleaning blade 23*b* and a detaching mechanism 23*c* for detaching the image transfer bias roller 23*a* and the roller cleaning blade 23*b* from the intermediate image transfer belt 19.

The bias roller 23*a* is normally positioned away from the intermediate image transfer belt 19, but is brought into pressure contact with the intermediate image transfer belt 19 by the detaching mechanism 23*c* in accordance with a timing of the transfer of the full-color toner image formed on the intermediate image transfer belt 19 to the image transfer sheet 24, and applies a predetermined bias voltage to the intermediate image transfer belt 19. Thus, the full-color toner image formed on the intermediate image transfer belt 19 is transferred to the image transfer sheet 24.

As shown in FIG. 1, the image transfer sheet 24 is fed by sheet feeding rollers 25 and a resist roller 26 in accordance with a timing of the leading edge of the full-color toner image formed on the intermediate image transfer belt 19 reaching an image transfer position of the image transfer sheet 24.

The image transfer sheet 24 to which the full-color toner image has been transferred is transported to an image fixing unit 28 by an image transfer sheet transporting unit 27, so that the full-color toner image is fixed to the image transfer sheet 24 by an image fixing roller 28*a* with a predetermined controlled temperature and a pressure application roller 28*b*. After the toner image is transferred to the image transfer sheet 24, the surface of the intermediate image transfer belt 19 is cleaned by the belt cleaning unit 22 being brought into pressure contact with the intermediate image transfer belt 19 by the detaching mechanism 22*c*.

In the above is explained how to obtain the full-color toner image based on the color image data in a four-color mode of black, cyan, magenta and yellow. In the case of either a three-color mode or a two-color, a toner image can be formed on the image transfer sheet in the same way as mentioned above, by forming a latent electrostatic image based on each designated color, and operating the development unit for each color.

A monochrome toner image can be formed on the image transfer sheet by setting only the development unit for the color in operation, with the intermediate image transfer belt 19 being driven in rotation while kept in contact with the surface of the electrophotographic photoconductor 9 and also with the belt cleaning unit 22 being kept in contact with the surface of the intermediate image transfer belt 19.

The method of fire fixing an image on the heat-resistant resistant solid surface using a toner image bearing transfer sheet will now be explained in accordance with the flow diagram shown in FIG. 4.

Figure 4:
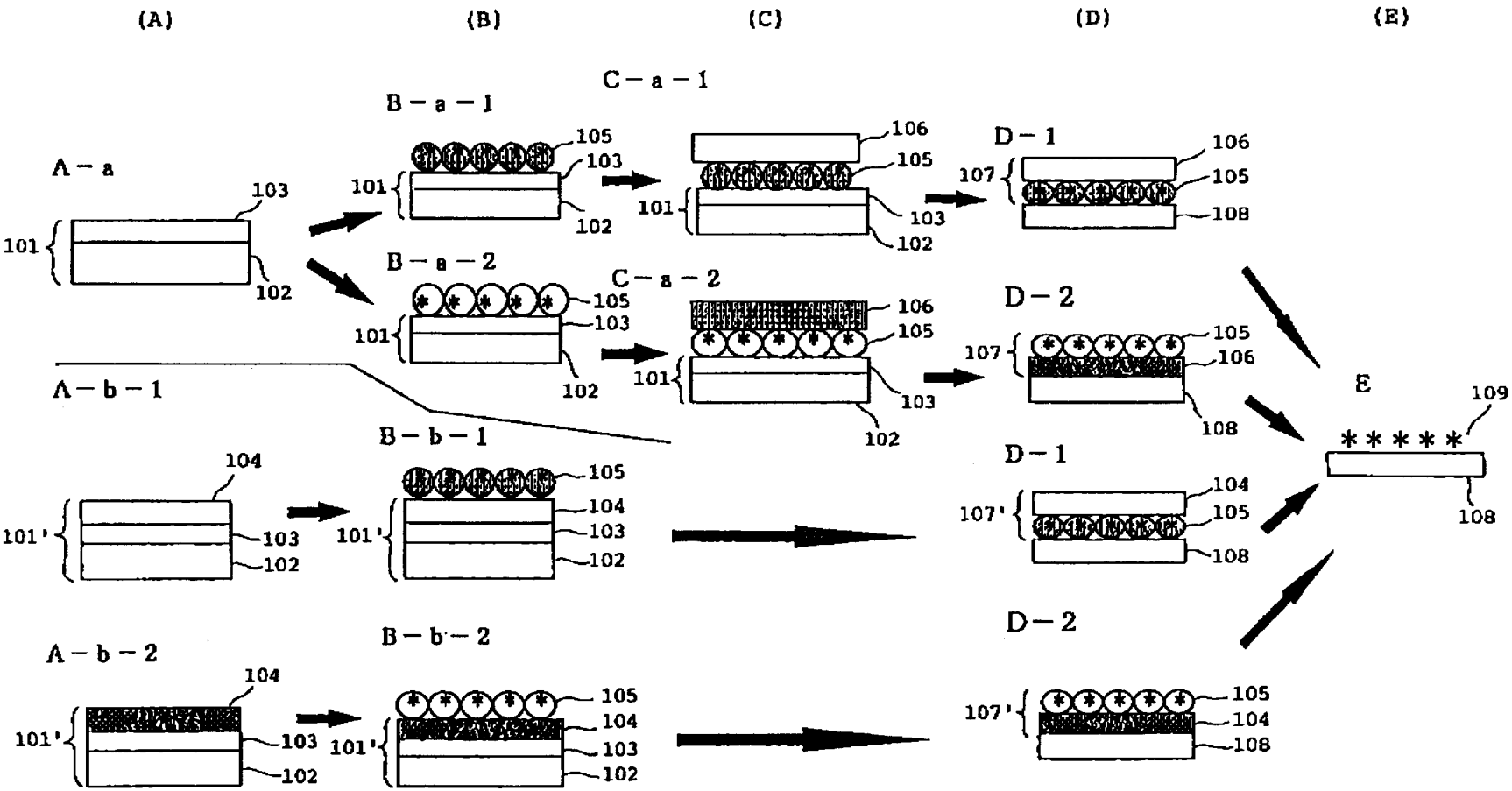
FIG. 4 is a flow diagram in explanation of the steps of forming a toner image on an image transfer sheet, transferring the toner image from the image transfer sheet to a heat-resistant solid surface, and sintering the toner image so as to fix the toner image on the solid surface according to the fire fixing method of the present invention.

As shown in FIG. 4, the process includes the steps of (A) preparing an image transfer sheet 101 (or 101'), (B) forming a toner image 105 on the image transfer sheet 101, (C) providing a resin film layer 106 on the toner image 105 when necessary, (D) attaching a toner image bearing film member 107 to the surface of a heat-resistant solid 108, and (E) sintering the toner image bearing film member 107.

In FIG. 4, when a thermoplastic resin for use in a toner image has a higher sintering temperature than that of a resin for use in a resin layer or a resin film layer, the toner image is shaded. Or when a resin for use in a resin layer of an image transfer sheet or a resin film layer to be provided on the toner image has a higher sintering temperature than that of a thermoplastic resin for use in the toner image, the resin layer or the resin film layer is shaded in FIG. 4. A mark * indicates a pigment 109 for use in the toner image 105.

In the present invention, it is preferable that the image transfer sheet 101 comprise a water-soluble layer 103 because a toner image bearing film member 107 can be peeled from a support 102 of the image transfer sheet 101. There can be employed an image transfer sheet 101 comprising a support 102 and a water-soluble layer 103 formed thereon, as indicated by (A-a), for example, a commercially available transfer sheet for pottery "OK Series SN-100" (Trademark), made by Nittoshiko Co., Ltd., and an image transfer sheet 101' comprising a support 102, and a water-soluble layer 103 and a resin layer 104 which are successively overlaid on the support 102 in this order, as indicated by (A-b-1) or (A-b-2).

The water-soluble layer 103 is readily dissolved when the toner image 105 is separated from the transfer sheet 101, for example, by immersing the toner image bearing transfer sheet in water, In this case, however, the toner image 105 has no self-supporting properties. When the image transfer sheet 101' comprises a resin layer 104, the toner image 105 and the resin layer 104 are separated together from the support 102 of the image transfer sheet 101 to form a toner image bearing film member 107'. The thus formed toner image bearing film member 107' can be favorably attached to the surface of the heat-resistant solid 108 since the resin layer 104 can support the toner image 105 thereon.

In any case, a toner image layer 105 is formed on the water-soluble layer 103 of the image transfer sheet 101 as indicated by (B-a-1) or (B-a-2), or on the resin layer 104 of the image transfer sheet 101' as indicated by (B-b-1) or (B-b-2) in the step (B) of transferring a toner image on the image transfer sheet by the electrophotographic process.

When the image transfer sheet 101 free from a resin layer 104 is employed, as indicated by (A-a), a resin film layer 106 may be coated on the toner image layer 105 as shown in (C-a-1) or (C-a-2). In the case where the image transfer sheet 101' having a resin layer 104 is employed as indicated by (A-b-1) or (A-b-2), the step of providing a resin film layer 106 on the toner image layer 105 is not necessary.

The thus obtained toner image bearing image transfer sheet is immersed in water, so that the water-soluble layer 103 of the image transfer sheet 101 (or 101') is dissolved, thereby obtaining a toner image bearing film member 107 (or 107') composed of the toner image layer 105 and the resin film layer 106 or the toner image layer 105 and the resin layer 104.

The toner image bearing film member 107 is attached to the surface of a heat-resistant solid 108. In this case, when the thermoplastic resin of the toner image 105 has a higher sintering temperature than that of the resin film layer 106 or resin layer 104, the toner image bearing film member 107 (or 107') may be attached to the heat-resistant solid surface 108 in such a direction that the toner image 105 comes in contact with the heat-resistant solid surface 108, as indicated by (D-1) in FIG. 4. On the other hand, when the resin layer 104 or resin film layer 106 has a higher sintering temperature than that of the thermoplastic resin for use in the toner image 105, the toner image bearing film member 107 (or 107') may be attached to the heat-resistant solid surface 108 in such a direction that the resin layer 104 or resin film layer 106 comes in contact with the heat-resistant solid surface 108, as indicated by (D-2) in FIG. 4.

The water-soluble layer 103 has been dissolved in water, so that the water-soluble layer 103 has no direct effect on the attachment to the heat-resistant solid surface 108. The toner image bearing film member 107 (or 107') is wetted with water, so that the toner image bearing film member 107 (or 107') can be closely attached to the heat-resistant solid surface 108 by the aid of surface tension of water.

Then, the toner image bearing film member 107 (or 107') attached to the heat-resistant solid surface 108 is sintered in the step (E). At that time, the resin film layer 106 (or the resin layer 104) and the thermoplastic resin for use in the toner image 105 are sintered. Only a pigment 109 contained in the toner remains on the heat-resistant solid surface 108, thereby obtaining an image on the solid surface 108.

The thickness of the water-soluble layer 103 for use in the image transfer sheet 101 is preferably in the range of about 1 to 2 $\mu$m; that of the toner image layer 105, in the range of 10 to 30 $\mu$m; and that of the resin layer 104 (or the resin film layer 106), in the range of 10 to 60 $\mu$m.

The apparatus for firing the toner image bearing heat-resistant solid is not particularly limited. In general, an electric oven or a gas oven is usable.

The position of an image to be formed in the heat-resistant solid, that is, the image in the surface portion of the heat-resistant solid or somewhat inner portion thereof can be selected by controlling the sintering temperature.

Namely, to obtain an image on the surface portion of the heat-resistant solid, for instance, the temperature in an electric or gas oven is gradually increased from room temperature to 750 to 850° C. by approximately 200° C./hour, and the temperature is maintained at 750 to 850° C. for 30 minutes to one hour. Thereafter, the oven is cooled to room temperature, and the image bearing heat-resistant solid is taken out of the oven. During the above-mentioned sintering step, the coloring agent contained in the toner is fixed to the surface portion of the heat-resistant solid by the action of the fritted glaze also contained in the toner. Thus, there can be obtained on the heat-resistant solid surface an image free of non-transferred spots or uneven firing.

On the other hand, to obtain an image in an inner portion of the heat-resistant solid, for instance, the temperature in an electric or gas oven is gradually increased from room temperature to 1100 to 1300° C. by approximately 200° C./hour, and the temperature is maintained at 1100 to 1300° C. for 30 minutes to one hour. Thereafter, the oven is cooled to room temperature, and the image bearing heat-resistant solid is taken out of the oven.

There is a risk of the image bearing heat-resistant solid being cracked or deformed in the sintering step when the heat-resistant solid is subjected to rapid change of temperature. The occurrence ratio of such a risk slightly varies depending upon the thickness and the kind of heat-resistant solid. Therefore, it is preferable that the increase or decrease rate of temperature in the oven be in the range of 50 to 500° C./hour, more preferably 100 to 300° C./hour. When the increase or decrease rate of temperature is within the range of 50 to 500° C./hour, production efficiency is not lowered, and the heat-resistant solid can be fired uniformly without any deformation.

Other features of this invention will become apparent in the course of the following description of exemplary embodiments, which are given for illustration of the invention and are not intended to be limiting thereof.

EXAMPLES A to F

1. Preparation of Two-component Developers 1-1. Preparation of Black, Yellow, Magenta and Cyan Toners <Preparation of Fritted Glaze>

A mixture of 80 g of $Al_2O_3$, 370 g of $SiO_2$, 50 g of $Na_2O$, and 500 g of PbO was pulverized in a stamp mill and blended in a Henschel mixer, and the thus obtained mixture was sintered at 1200° C. and pulverized. Thus, a fritted glaze was obtained.

<Preparation of Black Coloring Agent (1)>

A mixture of 110 g of $Cr_2O_3$, 270 g of MnO, 112 g of $Fe_2O_3$, and 508 g of $Co_2O_3$ was pulverized in a stamp mill and blended in a Henschel mixer, and the thus obtained mixture was sintered at 1100° C. and pulverized.

Then, 300 g of the thus prepared mixture and 500 g of the above obtained fritted glaze were blended in the Henschel mixer, and the resultant mixture was sintered at 750° C. and pulverized. Thus, a black coloring agent (1) comprising the alloy pigment was obtained.

<Preparation of Black Coloring Agent (2)>

A mixture of 110 g of $Cr_2O_3$, 270 g of MnO, 112 g of $Fe_2O_3$, and 508 g Of $Co_2O_3$ was pulverized in a stamp mill and blended in a Henschel mixer.

Then, 300 g of the thus prepared mixture and 500 g of the above obtained fritted glaze were blended in the Henschel mixer, whereby a black coloring agent (2) was obtained.

<Preparation of Yellow Coloring Agent>

A mixture of 10 g of CuO, 190 g of ZnO, and 800 g of $Sb_2O_3$ was pulverized in a stamp mill and blended in a Henschel mixer, and the thus obtained mixture was sintered at 1100° C. and pulverized.

Then, 300 g of the thus prepared mixture and 500 g of the above obtained fritted glaze were blended in the Henschel mixer, and the resultant mixture was sintered at 750° C. and pulverized. Thus, a yellow coloring agent comprising the alloy pigment was obtained.

<Preparation of Magenta Coloring Agent>

A mixture of 160 g of $Fe_2O_3$, 40 g of NiO, 40 g of CuO, and 760 g of $Au_2O$ was pulverized in a stamp mill and blended in a Henschel mixer, and the thus obtained mixture was sintered at 1100° C. and pulverized.

Then, 300 g of the thus prepared mixture and 500 g of the above obtained fritted glaze were blended in the Henschel mixer, and the resultant mixture was sintered at 750° C. and pulverized. Thus, a magenta coloring agent comprising the alloy pigment was obtained.

<Preparation of Cyan Coloring Agent>

A mixture of 170 g of $Cr_2O_3$, 10 g of $Fe_2O_3$, 690 g of $Co_2O_3$, and 130 g of ZnO was pulverized in a stamp mill and blended in a Henschel mixer, and the thus obtained mixture was sintered at 1100° C. and pulverized.

Then, 300 g of the thus prepared mixture and 500 g of the above obtained fritted glaze were blended in the Henschel mixer, and the resultant mixture was sintered at 750° C. and pulverized. Thus, a cyan coloring agent comprising the alloy pigment was obtained.

Using each of the above prepared coloring agents, a thermoplastic resin, a charge control agent, and hydrophobic silica, a color toner was prepared.

The following additive components were common to the black, yellow, magenta and cyan toners used in Examples and Comparative Examples shown below.

Charge control agent;

Zinc salicylate derivative "Bontron E84" (Trademark), made by Orient Chemical Industries, Ltd.

Hydrophobic silica:

"R972" (Trademark), made by Nippon Aerosil Co., Ltd.

In each Example, the kind of thermoplastic resin for use in the toner was different, and the amounts of the above-mentioned additive components were also different.

The volume mean diameter of the black toner was controlled to 9.3 μm; that of the yellow toner, 9.3 μm; that of the magenta toner, 9.1 μm; and that of the cyan toner, 9.0 μm.

1-2. Preparation of Carrier

The following components were dispersed in a homomixer for 30 minutes, whereby a coating layer formation liquid was prepared:

| | Parts by Weight |
|---|---|
| Silicone resin (Trademark "KR50" made by Shin-Etsu Chemical Co., Ltd.) | 100 |
| Carbon black (Trademark "BP2000" made by Cabot Corporation) | 3 |
| Toluene | 100 |

The above prepared coating layer formation liquid and 1000 parts by weight of spherical ferrite particles with an average particle diameter of 70 μm were placed in a fluidized bed type coating apparatus so as to provide a coating layer on the spherical ferrite particles. Thus, a resin-coated carrier was prepared.

1-3. Preparation of Two-component Developers

Each of the above prepared color toners and the resin-coated carrier were mixed and stirred in a ball mill for 15 minutes, thereby obtaining a black developer (Bk), a yellow developer (Y), a magenta developer (M), and a cyan developer (C).

2. Image Formation 2-1. Transfer of Toner Image to Image Transfer Sheet 450 g of each of the above obtained color developers was incorporated in each of color development units of a commercially available electrophotographic color copying machine (Trademark "PRETER 650" made by Ricoh Company, Ltd.). A full-color image was formed on a commercially available transfer sheet for pottery (Trademark "OK Series SN-100" made by Nittoshiko Co., Ltd.) under the following electrophotographic conditions:

[Electrophotographic Conditions]

Feeding speed of transfer sheet: 180 mm/sec

Charging potential: −650 V

Potential after exposure: −100 V to −500 V

Developing bias: −500 V

Transfer bias for belt: 1400 V to 1700 V

Transfer bias for transfer sheet: 900 V to 1500 V

Image fixing temperature; shown in each Example 2-2. Formation of Toner Image on Heat-resistant Solid Surface After the toner image was formed on the transfer sheet, a resin solution was coated on the toner image and dried so as to provide a resin film layer on the toner image.

The thus obtained toner image bearing transfer sheet was immersed into water, and the resin film layer and the toner image were separated together from the support of the transfer sheet to form a toner image bearing film member. The thus formed toner image bearing film member was then attached to a commercially available tile (Trademark "RS252/1001" made by INAX Co., Ltd.).

2-3. Sintering

The toner image bearing tile was gradually heated to 800° C. at an increase rate of 100° C./hour, and maintained at 800° C. for 30 minutes, and thereafter cooled to room temperature, whereby a toner image was sintered on the tile.

Instead of the tile, a toner image was sintered on a material made of pottery, marble, enamel or glass. In this case, the process of sintering the toner image was repeated in the same manner as in the sintering of the toner image on the tile. Further, while the temperature was increased to 800° C., the increase rate was changed to 200° C./hour, 300° C./hour, 400° C./hour and 500° C./hour.

2-4. Evaluation of Sintered Image Formed on Heat-resistant Solid

The sintered image thus obtained on each heat-resistant solid surface was visually inspected. The image was evaluated on the following scales:

○: There was obtained a clear image free of non-transferred spots.

Δ: Non-transferred spots slightly observed in a sintered image was acceptable in practice.

x: There was observed a non-transferred spot with a size of about 3 mm or more in a sintered image.

xx: There was observed a mat image in which non-transferred spots with a size of about 3 mm or more were formed in series.

Example A-1

[Preparation of Two-component Color Developers]

100 parts by weight of an epoxy resin (Tg=60° C.), 4 parts by weight of the charge control agent, and 230 parts by weight of the coloring agent (the previously mentioned black coloring agent (1), yellow coloring agent, magenta coloring agent or cyan coloring agent) were mixed in a mixer, and kneaded under the application of heat thereto using a two-roll mill. After the thus kneaded mixture was subjected to milling and cooled, the mixture was pulverized and classified so as to adjust the volume mean diameter of toner particles.

To those toner particles, the hydrophobic silica was added in an amount of 0.5 wt. %, and the obtained mixture was stirred in a mixer, whereby each color toner was prepared.

80 g of each color toner and 920 g of the carrier were mixed to prepare a two-component black (Bk), yellow (Y), magenta (M) or cyan (C) developer A-1.

[Formation of Toner Image on Image Transfer Sheet]

With the commercially available electrophotographic color copying machine "PRETER 650" (Trademark), made by Ricoh Company, Ltd., being supplied with the above prepared black, yellow, magenta and cyan developers (A-1), a toner image was formed on the previously mentioned commercially available transfer sheet under such electrophotographic conditions as mentioned above, provided that the image fixing temperature was set to 180° C.

After the formation of the toner image on the transfer sheet, a solution of polystyrene resin was coated on the toner image side of the image transfer sheet, and dried, so that a resin film layer was provided on the toner image layer.

[Sintering]

The toner image layer and the resin film layer were separated together from the support of the transfer sheet, thereby forming a toner image bearing film member. The toner image bearing film member was attached to the surface of the previously mentioned commercially available tile.

The toner image bearing tile was sintered under the previously mentioned sintering conditions. Thus, the toner image was sintered and fixed to the tile. The image thus obtained on the tile was evaluated on the scales as mentioned above.

The toner concentration (wt. %) in each color developer (A-1) measured by the blow-off method, and the results of the image evaluation are shown in Table Examples A-2 to A-4 and Comparative Examples A-1 and A-2

Two-component black, yellow, magenta and cyan developers were prepared in the same manner as in Example A-1 except that the amount ratio by weight of the toner to the carrier was changed as shown in Table 1.

A toner image was formed on the image transfer sheet, and the toner image bearing tile was sintered in the same manner as in Example A-1.

The toner concentration (wt. %) in each color developer measured by the blow-off method, and the results of the image evaluation are shown in Table 1.

TABLE 1

| | Amounts of Toner and Carrier (g) (*) | | Toner Concentration (wt. %) | Evaluation of Sintered Image |
|---|---|---|---|---|
| | Toner | Carrier | | |
| Ex. A-1 | 80 | 920 | 8.0 | ○ |
| Ex. A-2 | 130 | 870 | 13 | ○ |
| Ex. A-3 | 180 | 820 | 18 | ○ |
| Ex. A-4 | 240 | 760 | 24 | ○ |
| Comp. Ex. A-1 | 75 | 925 | 7.5 | Δ |
| Comp. Ex. A-2 | 245 | 755 | 24.5 | x |

(*) The amount ratio of toner to carrier was common to the black, yellow, magenta and cyan developers.

In the case where a toner replenishment unit was set in the copying machine in the above-mentioned Examples A-1 to A-4, the toner concentration was maintained in the range of 8 to 24 wt. % even after a toner image was continuously formed on 3,000 transfer sheets.

In contrast to this, when the toner replenishment unit was not set in the copying machine, the toner concentration was lowered to about 6 wt. % after a toner image was continuously formed on 1,000 sheets. When the toner image was sintered on the tile using such a toner image bearing transfer sheet prepared by use of a developer with a low toner concentration, there appeared on the surface of tile a mat image in which non-transferred spots with a size of 3 mm or more were formed in series.

Furthermore, the procedure for fire fixing a toner image on the tile in Example A-1 was repeated except that the black coloring agent (1) for use in the black developer was replaced by the black coloring agent (2). The result was that the black toner concentration was maintained in the range of 8 to 24 wt. % at the initial stage, and the sintered image on the tile was free from non-transferred spots although the black color density was slightly lowered.

In addition, the toner image was sintered on the pottery, marble, enamel or glass material instead of the tile in Examples A-1 to A-4. In any case, there was obtained a sintered image free of non-transferred spots.

Example B-1

[Preparation of Two-component Color Developers]

100 parts by weight of an epoxy resin (Tg=60° C.), 4 parts by weight of the charge control agent, and 230 parts by weight of the coloring agent (the previously mentioned black coloring agent (1), yellow coloring agent, magenta coloring agent or cyan coloring agent) were mixed in a mixer, and kneaded under the application of heat thereto using a two-roll mill. After the thus kneaded mixture was subjected to milling and cooled, the mixture was pulverized and classified so as to adjust the volume mean diameter of toner particles.

To those toner particles, the hydrophobic silica was added in an amount of 0.5 wt. %, and the obtained mixture was stirred in a mixer, whereby each color toner was prepared.

90 g of each color toner and 910 g of the carrier were mixed to prepare a two-component black (Bk), yellow (Y), magenta (M) or cyan (C) developer B-1.

[Formation of Toner Image on Image Transfer Sheet]

With the commercially available electrophotographic color copying machine "PRETER 650" (Trademark), made by Ricoh Company, Ltd., being supplied with the above prepared black, yellow, magenta and cyan developers (B-1), a toner image was formed on the previously mentioned commercially available transfer sheet under such electrophotographic conditions as mentioned above, provided that the image fixing temperature was set to 180° C.

After the formation of the toner image on the transfer sheet, a solution of polystyrene resin was coated on the toner image side of the image transfer sheet, and dried, so that a resin film layer was provided on the toner image layer.

[Sintering]

The toner image layer and the resin film layer were separated together from the support of the transfer sheet, thereby forming a toner image bearing film member. The toner image bearing film member was attached to the surface of the previously mentioned commercially available tile.

The toner-image bearing tile was sintered under the previously mentioned sintering conditions. Thus, the toner image was sintered and fixed to the tile. The image thus obtained on the tile was evaluated on the scales as mentioned above.

The charge quantity ($\mu$C/g) of toner for use in each color developer (B-1) measured by the blow-off method, and the results of the image evaluation are shown in Table 3.

Example B-2 and B-3 and Comparative Examples B-1 and B-2

Two-component black, yellow, magenta and cyan developers were prepared in the same manner as in Example B-1 except that the amount of the hydrophobic silica added to the toner was changed as shown in Table 2.

TABLE 2

| | Amount of Hydrophobic Silica (wt. %) |
|---|---|
| Ex. B-2 | 0.25 |
| Ex. B-3 | 0.75 |
| Comp. Ex. B-1 | 1.5 |
| Comp. Ex. B-2 | 3.0 |

A toner image was formed on the image transfer sheet, and the toner image bearing tile was sintered in the same manner as in Example B-1.

The charge quantity ($\mu$C/g) of toner for use in each color developer measured by the blow-off method, and the results of the image evaluation are shown in Table 3.

TABLE 3

| | Charge Quantity of Toner (μC/g) | | | | Evaluation of Sintered |
|---|---|---|---|---|---|
| | Bk | Y | M | C | Image |
| Ex. B-1 | −10.4 | −7.9 | −11.4 | −9.7 | ○ |
| Ex. B-2 | −6.2 | −5.2 | −7.6 | −4.9 | ○ |
| Ex. B-3 | −11.8 | −10.6 | −12.0 | −11.6 | ○ |
| Comp. Ex. B-1 | −13.1 | −12.9 | −13.3 | −12.6 | Δ |
| Comp. Ex. B-2 | −25.4 | −23.8 | −27.2 | −27.1 | x |

In the case where a toner replenishment unit was set in the copying machine in the above-mentioned Examples B-1 to B-3, the absolute charge quantity value of toner was 12 μC/g or less even after a toner image was continuously formed on 3,000 transfer sheets. In this case, a clear image free of non-transferred spots was formed on the surface of tile.

In contrast to this, when the toner replenishment unit was not set in the copying machine, the absolute charge quantity value of toner exceeded 12 μC/g after a toner image was continuously formed on 1,000 sheets. When the toner image was sintered on the tile using such a toner image bearing transfer sheet prepared by use of a developer with a low absolute charge quantity value of toner, there appeared on the surface of tile a mat image in which non-transferred spots with a size of 3 mm or more were formed in series.

Furthermore, the procedure for fire fixing a toner image on the tile in Example B-1 was repeated except that the black coloring agent (1) for use in the black developer was replaced by the black coloring agent (2). The result was that the absolute charge quantity value of black toner was maintained at 12 μC/g or less at the initial stage, and the sintered image on the tile was free from non-transferred spots although the black color density was slightly lowered.

In addition, the toner image was sintered on the pottery, marble, enamel or glass material instead of the tile in Examples B-1 to B-3. In any case, there was obtained a sintered image free of non-transferred spots.

Example C-1

[Preparation of Two-component Color Developers]

100 parts by weight of an epoxy resin (Tg=60° C.), 4 parts by weight of the charge control agent, and 230 parts by weight of the coloring agent (the previously mentioned black coloring agent (1), yellow coloring agent, magenta coloring agent or cyan coloring agent) were mixed in a mixer, and kneaded under the application of heat thereto using a two-roll mill. After the thus kneaded mixture was subjected to milling and cooled, the mixture was pulverized and classified so as to adjust the volume mean diameter of toner particles.

To those toner particles, the hydrophobic silica was added in an amount of 0.5 wt. %, and the obtained mixture was stirred in a mixer, whereby each color toner was prepared.

90 g of each color toner and 910 g of the carrier were mixed to prepare a two-component black (Bk), yellow (Y), magenta (M) or cyan (c) developer C-1.

[Formation of Toner Image on Image Transfer Sheet]

With the commercially available electrophotographic color copying machine "PRETER 650" (Trademark), made by Ricoh Company, Ltd., being supplied with the above prepared black, yellow, magenta and cyan developers (C-1), a toner image was formed on the previously mentioned commercially available transfer sheet under such electrophotographic conditions as mentioned above, provided that the image fixing temperature was set to 180° C.

After the formation of the toner image on the transfer sheet, a solution of polystyrene resin was coated on the toner image side of the image transfer sheet, and dried, so that a resin film layer was provided on the toner image layer.

[Sintering]

The toner image layer and the resin film layer were separated together from the support of the transfer sheet, thereby forming a toner image bearing film member. The toner image bearing film member was attached to the surface of the previously mentioned commercially available tile.

The toner image bearing tile was sintered under the previously mentioned sintering conditions. Thus, the toner image was sintered and fixed to the tile. The image thus obtained on the tile was evaluated on the scales as mentioned above.

The ratio of a true specific gravity of the carrier to that of the toner for use in each color developer (C-1) measured in accordance with JIS Z 8807, and the results of the image evaluation are shown in Table 5.

Examples C-2 to C-5 and Comparative Examples C-1 to C-3

Two-component black, yellow, magenta and cyan developers were prepared in the same manner as in Example C-1 except that the amount of the epoxy resin for use in each color toner was changed as shown in Table 4.

TABLE 4

| | Amount of Epoxy resin (g) |
|---|---|
| Ex. C-2 | 70 |
| Ex. C-3 | 130 |
| Ex. C-4 | 165 |
| Ex. C-5 | 200 |
| Comp. Ex. C-1 | 20 |
| Comp. Ex. C-2 | 230 |
| Comp. Ex. C-3 | 260 |

A toner image was formed on the image transfer sheet, and the toner image bearing tile was sintered in the same manner as in Example C-1.

The ratio of a true specific gravity of the carrier to that of the toner for use in each color developer measured in accordance with JIS Z 8807, and the results of the image evaluation are shown in Table Table 5.

TABLE 5

| | Ratio of True Specific Gravity of Carrier to that of Toner | | | | Evaluation of Sintered |
|---|---|---|---|---|---|
| | Bk | Y | M | C | Image |
| Ex. C-1 | 2.15 | 2.30 | 2.34 | 2.31 | ○ |
| Ex. C-2 | 2.03 | 2.00 | 2.01 | 2.02 | ○ |
| Ex. C-3 | 2.21 | 2.40 | 2.41 | 2.42 | ○ |
| Ex. C-4 | 2.41 | 2.55 | 2.61 | 2.62 | ○ |
| Ex. C-5 | 2.82 | 2.97 | 2.98 | 2.99 | ○ |
| Comp. Ex. C-1 | 1.88 | 1.94 | 1.98 | 1.97 | Δ |
| Comp. Ex. C-2 | 3.10 | 3.01 | 3.05 | 3.02 | x |
| Comp. Ex. C-3 | 3.14 | 3.20 | 3.21 | 3.18 | xx |

Furthermore, the procedure for fire fixing a toner image on the tile in Example C-1 was repeated except that the black coloring agent (1) for use in the black developer was replaced by the black coloring agent (2). The result was that the ratio of a true specific gravity of the carrier to that of the black toner was maintained in the range of 2 to 3 at the initial stage, and the sintered image on the tile was free from non-transferred spots although the black color density was slightly lowered.

In addition, the toner image was sintered on the pottery, marble, enamel or glass material instead of the tile in Examples C-1 to C-5. In any case, there was obtained a sintered image free of non-transferred spots.

Example D-1

[Preparation of Two-component Color Developers]

100 parts by weight of an epoxy resin (Tg=60° C.), 4 parts by weight of the charge control agent, and 230 parts by weight of the coloring agent (the previously mentioned black coloring agent (1), yellow coloring agent, magenta coloring agent or cyan coloring agent) were mixed in a mixer, and kneaded under the application of heat thereto using a two-roll mill. After the thus kneaded mixture was subjected to milling and cooled, the mixture was pulverized and classified so as to adjust the volume mean diameter of toner particles.

To those toner particles, the hydrophobic silica was added in an amount of 0.5 wt. %, and the obtained mixture was stirred in a mixer, whereby each color toner was prepared.

90 g of each color toner and 910 g of the carrier were mixed to prepare a two-component black (Bk), yellow (Y), magenta (M) or cyan (C) developer D-1.

[Formation of Toner Image on Image Transfer Sheet]

With the commercially available electrophotographic color copying machine "PRETER 650" (Trademark), made by Ricoh Company, Ltd., being supplied with the above prepared black, yellow, magenta and cyan developers (D-1), a toner image was formed on the previously mentioned commercially available transfer sheet under such electrophotographic conditions as mentioned above, provided that the image fixing temperature was set to 180° C.

Then, the glossiness (%) of the toner image formed on the transfer sheet was measured by the previously mentioned method. The measurement of glossiness was carried out at three positions, that is, the top portion of the toner image through which the image fixing roller was caused to pass first, the center portion thereof, and the end portion thereof. The results are shown in Table 7.

After the formation of the toner image on the transfer sheet, a solution of polystyrene resin was coated on the toner image side of the image transfer sheet, and dried, so that a resin film layer was provided on the toner image layer.

[Sintering]

The toner image layer and the resin film layer were separated together from the support of the transfer sheet, thereby forming a toner image bearing film member. The toner image bearing film member was attached to the surface of the previously mentioned commercially available tile.

The toner image bearing tile was sintered under the previously mentioned sintering conditions. Thus, the toner image was sintered and fixed to the tile. The image thus obtained on the tile was evaluated on the scales as mentioned above.

The results of the image evaluation are shown in Table 8.

Examples D-2 to D-4 and Comparative Examples D-1 to D-4

Two-component black, yellow, magenta and cyan developers were prepared in the same manner as in Example D-1. Thereafter, a toner image was transferred to the image transfer sheet in the same manner as in Example D-1 except that the image fixing temperature was changed as shown in Table 6.

TABLE 6

| | Image Fixing Temperature (° C.) |
|---|---|
| Ex. D-1 | 180 |
| Ex. D-2 | 185 |
| Ex. D-3 | 190 |
| Ex. D-4 | 195 |
| Comp. Ex. D-1 | 160 |
| Comp. Ex. D-2 | 165 |
| Comp. Ex. D-3 | 170 |
| Comp. Ex. D-4 | 175 |

The toner image bearing tile was sintered in the same manner as in Example D-1.

The glossiness of the toner image formed on the transfer sheet, and the results of the image evaluation after sintering are respectively shown in Table 7 and Table 8.

TABLE 7

| | Glossiness of Toner Image (%) | | |
|---|---|---|---|
| | Top portion | Center portion | End portion |
| Ex. D-1 | 11 | 10 | 9 |
| Ex. D-2 | 16 | 14 | 13 |
| Ex. D-3 | 17 | 15 | 14 |
| Ex. D-4 | 20 | 18 | 16 |
| Comp. Ex. D-1 | 3 | 3 | 3 |
| Comp. Ex. D-2 | 5 | 4 | 4 |
| Comp. Ex. D-3 | 6 | 6 | 5 |
| Comp. Ex. D-4 | 8 | 7 | 6 |

TABLE 8

| | Evaluation of Sintered Image | | |
|---|---|---|---|
| | Top portion | Center portion | End portion |
| Ex. D-1 | ○ | ○ | ○ |
| Ex. D-2 | ○ | ○ | ○ |
| Ex. D-3 | ○ | ○ | ○ |
| Ex. D-4 | Δ | Δ | Δ |
| Comp. Ex. D-1 | xx | xx | xx |
| Comp. Ex. D-2 | x | x | x |
| Comp. Ex. D-3 | Δ | x | x |
| Comp. Ex. D-4 | ○ | Δ | x |

Furthermore, the procedure for fire fixing a toner image on the tile in Example D-1 was repeated except that the black coloring agent (1) for use in the black developer was replaced by the black coloring agent (2). The result was that the glossiness of the toner image transferred to the image transfer sheet was 6% or more at the initial stage, and the sintered image on the tile was free from non-transferred spots although the black color density was slightly lowered.

In addition, the toner image was sintered on the pottery, marble, enamel or glass material instead of the tile in Examples D-1 to D-4. In any case, there was obtained a sintered image free of non-transferred spots.

Example E-1

[Preparation of Two-component Color Developers]

100 parts by weight of a styrene-n-butyl acrylate copolymer resin (ratio of 83:17, Tg=60° C.), 4 parts by weight of the charge control agent, and 230 parts by weight of the coloring agent (the previously mentioned black coloring agent (1), yellow coloring agent, magenta coloring agent or cyan coloring agent) were mixed in a mixer, and kneaded under the application of heat thereto using a two-roll mill. After the thus kneaded mixture was subjected to milling and cooled, the mixture was pulverized and classified so as to adjust the volume mean diameter of toner particles.

To those toner particles, the hydrophobic silica was added in an amount of 0.5 wt. %, and the obtained mixture was stirred in a mixer, whereby each color toner was prepared.

90 g of each color toner and 910 g of the carrier were mixed to prepare a two-component black (Bk), yellow (Y), magenta (M) or cyan (C) developer E-1.

[Formation of Toner Image on Image Transfer Sheet]

With the commercially available electrophotographic color copying machine "PRETER 650" (Trademark), made by Ricoh Company, Ltd., being supplied with the above prepared black, yellow, magenta and cyan developers (E-1), a toner image was formed on the previously mentioned commercially available transfer sheet under such electrophotographic conditions as mentioned above, provided that the image fixing temperature was set to 180° C.

Then, the image density decreasing ratio (%) of the toner image formed on the transfer sheet was measured by the previously mentioned method. The measurement of the image density decreasing ratio was carried out at three positions, that is, the top portion of the toner image through which the image fixing roller was caused to pass first, the center portion thereof, and the end portion thereof. The results are shown in Table 10.

After the formation of the toner image on the transfer sheet, a solution of polystyrene resin was coated on the toner image side of the image transfer sheet, and dried, so that a resin film layer was provided on the toner image layer.

[Sintering]

The toner image layer and the resin film layer were separated together from the support of the transfer sheet, thereby forming a toner image bearing film member. The toner image bearing film member was attached to the surface of the previously mentioned commercially available tile.

The toner image bearing tile was sintered under the previously mentioned sintering conditions. Thus, the toner image was sintered and fixed to the tile. The image thus obtained on the tile was evaluated on the scales as mentioned above.

The results of the image evaluation after sintering are shown in Table 11.

Examples E-2 and E-3 and Comparative Examples E-1 to E-5

Two-component black, yellow, magenta and cyan developers were prepared in the same manner as in Example E-1. Thereafter, a toner image was formed on the image transfer sheet in the same manner as in Example E-1 except that the image fixing temperature was changed as shown in Table 9.

TABLE 9

| | Image Fixing Temperature (° C.) |
|---|---|
| Ex. E-1 | 180 |
| Ex. E-2 | 185 |
| Ex. E-3 | 190 |
| Comp. Ex. E-1 | 195 |
| Comp. Ex. E-2 | 160 |
| Comp. Ex. E-3 | 165 |
| Comp. Ex. E-4 | 170 |
| Comp. Ex. E-5 | 175 |

The toner image bearing tile was sintered in the same manner as in Example E-1.

The image density decreasing ratio of the toner image formed on the image transfer sheet, and the results of the image evaluation after sintering are respectively shown in Table 10 and Table 11.

TABLE 10

| | Image Density Decreasing Ratio of Toner Image (%) | | |
|---|---|---|---|
| | Top portion | Center portion | End portion |
| Ex. E-1 | 14 | 10 | 9 |
| Ex. E-2 | 8 | 10 | 13 |
| Ex. E-3 | 30 | 28 | 26 |
| Comp. Ex. E-1 | 34 | 32 | 31 |
| Comp. Ex. E-2 | 50 | 45 | 45 |
| Comp. Ex. E-3 | 33 | 35 | 38 |
| Comp. Ex. E-4 | 31 | 32 | 34 |
| Comp. Ex. E-5 | 25 | 28 | 31 |

TABLE 11

| | Evaluation of Sintered Image | | |
|---|---|---|---|
| | Top portion | Center portion | End portion |
| Ex. E-1 | ○ | ○ | ○ |
| Ex. E-2 | ○ | ○ | ○ |
| Ex. E-3 | ○ | ○ | ○ |
| Comp. Ex. E-1 | Δ | Δ | Δ |
| Comp. Ex. E-2 | xx | xx | xx |
| Comp. Ex. E-3 | x | x | x |
| Comp. Ex. E-4 | Δ | x | x |
| Comp. Ex. E-5 | ○ | Δ | x |

Furthermore, the procedure for fire fixing a toner image on the tile in Example E-1 was repeated except that the black coloring agent (1) for use in the black developer was replaced by the black coloring agent (2). The result was that the image density decreasing ratio of the toner image formed on the image transfer sheet was 30% or less at the initial stage, and the sintered image on the tile was free from non-transferred spots although the black color density was slightly lowered.

In addition, the toner image was sintered on the pottery, marble, enamel or glass material instead of the tile in Examples E-1 to E-3. In any case, there was obtained a sintered image free of non-transferred spots.

Example F-1

[Preparation of Two-component Color Developers]

100 parts by weight of a styrene-methyl acrylate copolymer resin (Tg=54° C.), 4 parts by weight of the charge control agent, and 230 parts by weight of the coloring agent (the previously mentioned black coloring agent (1), yellow coloring agent, magenta coloring agent or cyan coloring agent) were mixed in a mixer, and kneaded under the application of heat thereto using a two-roll mill. After the thus kneaded mixture was subjected to milling and cooled, the mixture was pulverized and classified so as to adjust the volume mean diameter of toner particles.

To those toner particles, the hydrophobic silica was added in an amount of 0.5 wt. %, and the obtained mixture was stirred in a mixer, whereby each color toner was prepared.

The sintering temperature of the above-mentioned styrene-methyl acrylate copolymer resin for use in the toner was 340° C., which was measured by subjecting 1.0 mg of the resin to differential thermogravimetric analysis in TG-DTA mode using the commercially available measuring equipment "Differential Thermobalance" (Trademark), made by Sinkuriko. Inc.

90 g of each color toner and 910 g of the carrier were mixed to prepare a two-component black (Bk), yellow (Y), magenta (M) or cyan (C) developer F-1.

[Formation of Toner Image on Image Transfer Sheet]

With the commercially available electrophotographic color copying machine "PRETER 650" (Trademark), made by Ricoh Company, Ltd., being supplied with the above prepared black, yellow, magenta and cyan developers (F-1), a toner image was formed on the previously mentioned commercially available transfer sheet under such electrophotographic conditions as mentioned above, provided that the image fixing temperature was set to 180° C.

After the formation of the toner image on the transfer sheet, a solution of butyral resin was coated on the toner image side of the image transfer sheet, and dried, so that a resin film layer was provided on the toner image layer. The sintering temperature of the above-mentioned butyral resin for use in the resin film layer was 500° C.

[Sintering]

The toner image layer and the resin film layer were separated together from the support of the transfer sheet by immersing the toner image bearing transfer sheet in water, thereby forming a toner image bearing film member. The toner image bearing film member was attached to the surface of the previously mentioned commercially available tile in such a direction that the butyral resin film layer of the toner image bearing film member was in contact with the surface of tile.

The toner image bearing tile was sintered under the previously mentioned sintering conditions. The toner image thus sintered and fixed to the tile was clear and free of non-transferred spots.

In addition, the toner image was sintered on the pottery, marble, enamel or glass material instead of the tile. In any case, there was obtained a sintered image free of non-transferred spots.

Example F-2

Two-component black, yellow, magenta and cyan developers were prepared in the same manner as in Example F-1.

The same butyral resin solution as employed for the formation of the resin film layer on the toner image in Example F-1 was coated on the image transfer sheet in advance, and dried, so that a butyral resin layer was provided on the water-soluble layer of the image transfer sheet. Then, a toner image was formed on the above-mentioned butyral resin layer of the image transfer sheet under the same electrophotographic conditions as in Example F-1.

The toner image bearing image transfer sheet was immersed in water, so that a toner image layer and the butyral resin layer were separated together from the support of the image transfer sheet, thereby forming a toner image bearing film member.

Then, the toner image bearing film member was attached to the surface of the previously mentioned commercially available tile in such a direction that the butyral resin layer was in contact with the surface of tile.

The toner image bearing tile was sintered under the previously mentioned sintering conditions. The toner image thus sintered and fixed to the tile was clear and free of non-transferred spots.

Example F-3

Two-component black, yellow, magenta and cyan developers were prepared in the same manner as in Example F-1 except that the styrene-methyl acrylate copolymer resin for use in the preparation of the toner in Example F-1 was replaced by a styrene-n-butyl copolymer resin with a sintering temperature of 360° C.

A toner image was transferred to the same image transfer sheet under the same electrophotographic conditions as in Example F-1.

After the formation of the toner image on the transfer sheet, the same butyral resin film layer was provided on the toner image layer in the same manner as in Example F-1.

The toner image layer and the resin film layer were separated together from the support of the transfer sheet by immersing the toner image bearing transfer sheet in water, thereby forming a toner image bearing film member. The toner image bearing film member was attached to the surface of the previously mentioned commercially available tile in such a direction that the butyral resin film layer was in contact with the surface of tile.

The toner image bearing tile was sintered under the previously mentioned sintering conditions. The toner image thus sintered and fixed to the tile was clear and free of non-transferred spots.

Example F-4

Two-component black, yellow, magenta and cyan developers were prepared in the same manner as in Example F-3.

The same butyral resin layer as in Example F-2 was provided on the image transfer sheet in advance. Then, a toner image was transferred to the above-mentioned butyral resin layer of the image transfer sheet under the same electrophotographic conditions as in Example F-2.

The toner image bearing image transfer sheet was immersed in water, so that a toner image and the butyral resin layer were separated together from the support of the image transfer sheet, thereby forming a toner image bearing film member.

Then, the toner image bearing film member was attached to the surface of the previously mentioned commercially available tile in such a direction that the butyral resin layer was in contact with the surface of tile.

The toner-image bearing tile was sintered under the previously mentioned sintering conditions. The toner image thus sintered and fixed to the tile was clear and free of non-transferred spots.

Comparative Example F-1

Two-component black, yellow, magenta and cyan developers were prepared in the same manner as in Example F-3.

A toner image was transferred to the same image transfer sheet under the same electrophotographic conditions as in Example F-3.

After the formation of the toner image on the transfer sheet, a polystyrene resin film layer with a sintering temperature of 350° C. was provided on the toner image layer.

The toner image layer and the resin film layer were separated together from the support of the transfer sheet by immersing the toner image bearing transfer sheet in water, thereby forming a toner image bearing film member. The toner image bearing film member was attached to the surface of the previously mentioned commercially available tile in such a direction that the polystyrene resin film layer was in contact with the surface of tile.

The toner image bearing tile was sintered under the previously mentioned sintering conditions. As a result, there appeared minute non-transferred spots with a size of about 1 mm in the sintered image on the tile.

Comparative Example F-2

Two-component black, yellow, magenta and cyan developers were prepared in the same manner as in Example F-3.

A toner image was transferred to the same image transfer sheet under the same electrophotographic conditions as in Example F-3.

After the formation of the toner image on the transfer sheet, a polyvinyl butyrate resin film layer with a sintering temperature of 340° C. was provided on the toner image layer.

The toner image layer and the resin film layer were separated together from the support of the transfer sheet by immersing the toner image bearing transfer sheet in water, thereby forming a toner image bearing film member. The toner image bearing film member was attached to the surface of the previously mentioned commercially available tile in such a direction that the polyvinyl butyrate resin film layer was in contact with the surface of tile.

The toner image bearing tile was sintered under the previously mentioned sintering conditions. As a result, there appeared non-transferred spots with a size of about 3 mm or more in the sintered image on the tile.

Comparative Example F-3

Two-component black, yellow, magenta and cyan developers were prepared in the same manner as in Example F-1.

A toner image was transferred to the same image transfer sheet under the same electrophotographic conditions as in Example F-1.

After the formation of the toner image on the transfer sheet, a polypropyl acrylate resin film layer with a sintering temperature of 330° C. was provided on the toner image layer.

The toner image layer and the resin film layer were separated together from the support of the transfer sheet by immersing the toner image bearing transfer sheet in water, thereby forming a toner image bearing film member. The toner image bearing film member was attached to the surface of the previously mentioned commercially available tile in such a direction that the polypropyl acrylate resin film layer was in contact with the surface of tile.

The toner image bearing tile was sintered under the previously mentioned sintering conditions. As a result, there appeared a mat image with non-transferred spots with a size of about 3 mm or more being formed in series therein.

Table 12 shows the relationship between the sintering temperature of the thermoplastic resin contained in the toner image and the sintering temperature of the resin film layer (or resin layer), and the evaluation of the sintered toner image.

TABLE 12

| | Thermoplastic Resin for use in Toner Image | | Resin for use in Resin (Film) Layer | | Evaluation of |
|---|---|---|---|---|---|
| | Kind | Sintering Temp. (° C.) | Kind | Sintering Temp. (° C.) | Sintered Image |
| Ex. F-1 | Styrene-methyl acrylate copolymer resin | 340 | (Resin film layer) Butyral resin | 500 | Excellent. Free of non-transferred spots. |
| Ex. F-2 | Styrene-methyl acrylate copolymer resin | 340 | (Resin layer) Butyral resin | 500 | Excellent. Free of non-transferred spots. |
| Ex. F-3 | Styrene-n-butyl copolymer resin | 360 | (Resin film layer) Butyral resin | 500 | Excellent. Free of non-transferred spots. |
| Ex. F-4 | Styrene-n-butyl copolymer resin | 360 | (Resin layer) Butyral resin | 500 | Excellent. Free of non-transferred spots. |
| Comp. Ex. F-1 | Styrene-n-butyl copolymer resin | 360 | (Resin film layer) Poly-styrene resin | 350 | Minute non-transferred spots with a size of 1 mm. |
| Comp. Ex. F-2 | Styrene-n-butyl copolymer resin | 360 | (Resin film layer) Poly-vinyl butyrate resin | 340 | Non-transferred spots with a size of 3 mm or more. |
| Comp. Ex. F-3 | Styrene-methyl acrylate copolymer resin | 340 | (Resin film layer) poly-propyl acrylate resin | 330 | Non-transferred spots with a size of 3 mm or more in series. |

According to the image formation method of the present invention, a toner image with a minimum void can be formed on a transfer sheet. When the thus prepared toner image bearing transfer sheet is attached to the surface of a heat-resistant solid and sintered, there can be formed on the solid surface a clear sintered image free of non-transferred spots.

Japanese Patent Applications Nos. 09-289106 and 09-289107 filed Oct. 6, 1997, Japanese Patent Applications Nos. 09-270467 and 09-270468 filed Sep. 17, 1997, Japanese Patent Application No. 09-276585 filed Sep. 24, 1997, and Japanese Patent Application No. 09-297703 filed Oct. 15, 1997 are hereby incorporated by reference.

What is claimed is:

1. A method of fire fixing an image on a heat-resistant solid surface comprising the steps of:

attaching closely to a heat-resistant solid surface, a toner image bearing film member comprising a resin film which bears thereon a toner image which is formed, using a solid developer comprising a carrier and a toner which comprises a thermoplastic resin and a coloring agent having a chromatic color and capable of retaining said chromatic color even after said toner is sintered, in such a direction that when said thermoplastic resin of said toner image has a higher sintering temperature than that of said resin film, said toner image comes into contact with said heat-resistant solid surface, while when said resin film has a higher sintering temperature than that of said thermoplastic resin of said toner image, said resin film comes into contact with said heat-resistant solid surface, and sintering said toner image bearing film member so as to fix said toner image to said heat-resistant solid surface at a temperature at least as high as the higher of the sintering temperature of the resin film and the sintering temperature of the thermoplastic resin.

2. A transfer sheet which bears thereon a toner image which is prepared by developing a latent electrostatic image to said toner image, using a developer which comprises a carrier and a toner comprising a thermoplastic resin and a coloring agent having a chromatic color and capable of retaining said chromatic color even after said toner is sintered, and transferring said toner image to said transfer sheet, said toner image transferred to said transfer sheet satisfying at least one of two conditions that:

(1) said toner image has a glossiness of 6% or more, and (2) said toner image has an image density decreasing ratio of 30% or less.

3. The transfer sheet as claimed in claim 2, wherein said toner image transferred to said transfer sheet satisfies said condition (1) that said toner image has a glossiness of 6% or more.

4. The transfer sheet as claimed in claim 2, wherein said toner image transferred to said transfer sheet satisfies said condition (2) that said toner image has an image density decreasing ratio of 30% or less.

5. The transfer sheet as claimed in claim 2, comprising:

a support, a water-soluble layer provided on said support, with said toner image being transferred onto said water-soluble layer, and a resin film layer provided on said toner image.

6. The transfer sheet as claimed in claim 2, comprising:

a support, a water-soluble layer provided on said support, and a resin layer provided on said water-soluble layer, with said toner image being transferred onto said resin layer.

7. The transfer sheet as claimed in claim 2, serving as a transfer sheet for decorating fire on a heat-resistant solid surface.

8. A transfer sheet comprising:

a support, a toner image formed using a toner which comprises a thermoplastic resin and a coloring agent having a chromatic color and capable of retaining said chromatic color even after sintered, and a resin film layer, said toner image and said resin film layer being overlaid, with either one on the other, on said support, wherein said thermoplastic resin of said toner has a sintering temperature which is lower than that of said resin film layer.

9. A method of fire fixing an image on a heat-resistant solid surface comprising the steps of:

attaching closely to a heat-resistant solid surface, a toner image bearing film member comprising a resin film which bears thereon a toner image which is formed, using a solid developer comprising a toner which comprises a thermoplastic resin and a coloring agent having a chromatic color and capable of retaining said chromatic color even after said toner is sintered, in such a direction that when said thermoplastic resin of said toner image has a higher sintering temperature than that of said resin film, said toner image comes into contact with said heat-resistant solid surface, while when said resin film has a higher sintering temperature than that of said thermoplastic resin of said toner image, said resin film comes into contact with said heat-resistant solid surface, and sintering said toner image bearing film member so as to fix said toner image to said heat-resistant solid surface at a temperature at least as high as the higher of the sintering temperature of the resin film and the sintering temperature of the thermoplastic resin.

10. A transfer sheet which bears thereon a toner image which is prepared by developing a latent electrostatic image to a toner image, using a developer which comprises a toner comprising a thermoplastic resin and a coloring agent having a chromatic color and capable of retaining said chromatic color even after said developer is sintered, and transferring said toner image to said transfer sheet, said toner image transferred to said transfer sheet satisfying at least one of two conditions that:

(1) said toner image has a glossiness of 6% or more, and (2) said toner image has an image density decreasing ratio of 30% or less.

* * * * *

UNITED STATES PATENT AND TRADEMARK OFFICE

CERTIFICATE OF CORRECTION

PATENT NO. : 6,361,906 B1
DATED : March 26, 2002
INVENTOR(S) : Hiromitsu Kawase et al.

It is certified that error appears in the above-identified patent and that said Letters Patent is hereby corrected as shown below:

Title page,
Item [57], ABSTRACT,
Line 2, "sheet include the" should read -- sheet includes the --.

Column 7,
Line 57, "JIS Z 6807," should read -- JIS Z 8807, --.

Column 10,
Line 44, "image bearings" should read -- image bearing --.

Column 18,
Line 29, "sheet in water," should read -- sheet in water. --.

Column 23,
Line 3, "shown in Table" should read -- shown in Table 1. --.

Column 26,
Line 47, "Table Table 5." should read -- Table 5. --.

Signed and Sealed this

Sixteenth Day of July, 2002

*Attest:*

*Attesting Officer*

JAMES E. ROGAN
*Director of the United States Patent and Trademark Office*